US011571908B2

(12) United States Patent
Ezumi et al.

(10) Patent No.: US 11,571,908 B2
(45) Date of Patent: Feb. 7, 2023

(54) PRINTING APPARATUS, CONTROL METHOD AND STORAGE MEDIUM

(71) Applicant: CANON KABUSHIKI KAISHA, Tokyo (JP)

(72) Inventors: Yosuke Ezumi, Moriya (JP); Takatoshi Nakano, Yokohama (JP); Atsushi Arai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/174,365

(22) Filed: Feb. 12, 2021

(65) Prior Publication Data

US 2021/0162768 A1 Jun. 3, 2021

Related U.S. Application Data

(63) Continuation of application No. 16/590,520, filed on Oct. 2, 2019, now Pat. No. 10,946,666.

(30) Foreign Application Priority Data

Oct. 5, 2018 (JP) ..... JP2018-189645

(51) Int. Cl.
*B41J 2/18* (2006.01)
*B41J 2/045* (2006.01)
*B41J 2/165* (2006.01)

(52) U.S. Cl.
CPC ..... *B41J 2/18* (2013.01); *B41J 2/04501* (2013.01); *B41J 2/16508* (2013.01); (Continued)

(58) Field of Classification Search
CPC . B41J 2/175; B41J 2/18; B41J 2/16508; B41J 2/04501; B41J 2/16538; B41J 2202/12; B41J 2202/20
See application file for complete search history.

(56) References Cited

U.S. PATENT DOCUMENTS 8,210,666 B2 7/2012 Hirashima
8,240,802 B2 8/2012 Nakano et al.
(Continued)

FOREIGN PATENT DOCUMENTS

EP 2412532 A1 2/2012
JP 2006-159610 A 6/2006
(Continued)

OTHER PUBLICATIONS

Feb. 13, 2020 European Search Report in European Patent Appln. No. 19200820.9.
(Continued)

*Primary Examiner* — An H Do
(74) *Attorney, Agent, or Firm* — Venable LLP

(57) ABSTRACT

An object of the present disclosure is to reduce power consumption while preventing a reduction in productivity. One embodiment of the present invention is a printing apparatus including: a print head that ejects a liquid; a circulation unit configured to circulate the liquid in a circulation path including the print head; a control unit configured to controls the circulation unit to execute periodic circulation by causing the circulation unit to circulate the liquid in the circulation path periodically at predetermined interval; and an input unit configured to input information on a suspension period during which the control unit suspends execution of the periodic circulation, wherein the control unit is set to start suspending the execution of the periodic circulation in accordance with the information and is set to resume execution of the periodic circulation when the suspension period indicated by the information is elapsed.

26 Claims, 12 Drawing Sheets

(52) U.S. Cl.
CPC ..... *B41J 2/16538* (2013.01); *B41J 2202/12* (2013.01); *B41J 2202/20* (2013.01)

(56) References Cited

U.S. PATENT DOCUMENTS

| | | | |
|---|---|---|---|
| 8,328,311 | B2 | 12/2012 | Nakano et al. |
| 8,366,230 | B2 | 2/2013 | Taira et al. |
| 8,371,673 | B2 | 2/2013 | Maru et al. |
| 8,506,064 | B2 | 8/2013 | Watanabe |
| 8,651,616 | B2 | 2/2014 | Maru et al. |
| 8,876,269 | B2 | 11/2014 | Hirano |
| 8,876,280 | B2 | 11/2014 | Ishikawa et al. |
| 9,004,640 | B2 | 4/2015 | Ishikawa et al. |
| 9,415,960 | B2 | 8/2016 | Asano et al. |
| 9,969,168 | B2 | 5/2018 | Takahashi |
| 9,975,340 | B2 | 5/2018 | Karita et al. |
| 10,223,624 | B2 | 3/2019 | Yamamuro et al. |
| 10,850,529 | B2 | 12/2020 | Nakano et al. |
| 10,946,666 | B2 | 3/2021 | Ezumi et al. |
| 2011/0032296 | A1 | 2/2011 | Nakano et al. |
| 2011/0249062 | A1 | 10/2011 | Nakano et al. |
| 2011/0279530 | A1 | 11/2011 | Love et al. |
| 2015/0070415 | A1 | 3/2015 | Ishikawa et al. |
| 2017/0197417 | A1 | 7/2017 | Karita et al. |
| 2017/0253042 | A1 | 9/2017 | Takahashi |
| 2020/0108627 | A1 | 4/2020 | Nakano et al. |
| 2021/0162768 | A1 | 6/2021 | Ezumi et al. |

FOREIGN PATENT DOCUMENTS

| | | | |
|---|---|---|---|
| JP | 2017-113976 | A | 6/2017 |
| JP | 2017-121784 | A | 7/2017 |
| JP | 2017-154419 | A | 9/2017 |
| JP | 2018-083310 | A | 5/2018 |
| JP | 2020-059136 | A | 4/2020 |

OTHER PUBLICATIONS

Jul. 12, 2022 Office Action in Japanese Patent Application No. 2020-156430 (with English translation).

PRINTING APPARATUS, CONTROL METHOD AND STORAGE MEDIUM

This application is a continuation of application Ser. No. 16/590,520 filed Oct. 2, 2019.

BACKGROUND OF THE INVENTION

Field of the Invention

The present invention relates to a printing apparatus, a control method, and a storage medium.

Description of the Related Art

Japanese Patent Laid-Open No. 2017-121784 has disclosed a printing apparatus that suppresses a rise in the ink density by performing ink circulation in a circulation-type ink supply system as a preparation operation each time a print job is received.

SUMMARY OF THE INVENTION

The printing apparatus described in Japanese Patent Laid-Open No. 2017-121784 has such a problem that productivity is reduced because ink circulation is performed each time a print job is received. In order to address the problem such as this, it is known to perform ink circulation periodically irrespective of the timing of reception of a print job, for example, every 30 minutes. However, in a case where the frequency of ink circulation performed periodically is high, the power consumption increases.

Consequently, in view of the above-described problem, an object of one embodiment of the present invention is to reduce power consumption while preventing a reduction in productivity.

One embodiment of the present invention is a printing apparatus including: a print head that ejects a liquid; a circulation unit configured to circulate the liquid in a circulation path including the print head; a control unit configured to controls the circulation unit to execute periodic circulation by causing the circulation unit to circulate the liquid in the circulation path periodically at predetermined interval; and an input unit configured to input information on a suspension period during which the control unit suspends execution of the periodic circulation, wherein the control unit is set to start suspending the execution of the periodic circulation in accordance with the information and is set to resume execution of the periodic circulation when the suspension period indicated by the information is elapsed.

Further features of the present invention will become apparent from the following description of exemplary embodiments with reference to the attached drawings.

DESCRIPTION OF THE EMBODIMENTS

In the following, with reference to the drawings, a liquid ejection head and a liquid ejection apparatus according to embodiments of the present invention are explained. In the following embodiments, an ink jet print head that ejects ink and an ink jet printing apparatus are explained with a specific configuration, but the present invention is not limited to this. For example, it is possible to apply the present invention also to a serial head printer, not limited to a line head printer. Further, it is possible to apply the liquid ejection head, the liquid ejection apparatus, and a supply method of liquid of the present invention to a printer, a copy machine, a facsimile having a communication system, an apparatus, such as a word processor having a printer unit, and further, an industrial printing apparatus combined compositely with various processing apparatuses. For example, it is possible to use the present invention for use of biochip manufacturing, electronic circuit printing, and so on. The embodiments described below are specific examples of the present invention, and therefore, various technically favorable restrictions are imposed. However, as long as the spirit of the present invention is observed, the embodiments are not limited to the embodiments described below or other specific methods.

<About Internal Configuration of Printing Apparatus>

Figure 1:
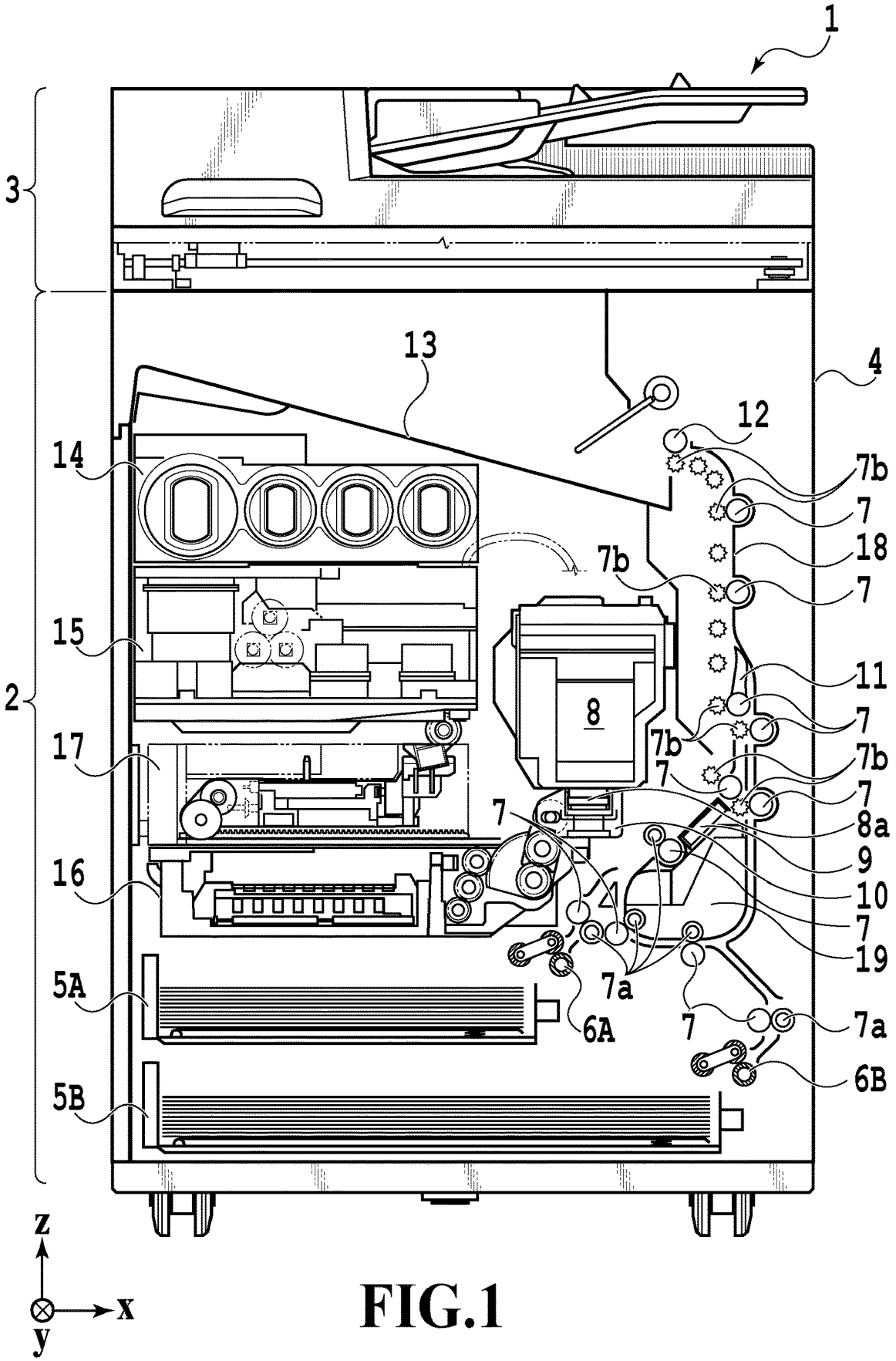
FIG. 1 a diagram in a case where a printing apparatus is in a standby state.

FIG. 1 is an internal configuration diagram of an ink jet printing apparatus 1 (hereinafter, referred to as printing apparatus 1). In FIG. 1, the x-direction indicates the horizontal direction, the y-direction (direction perpendicular to the paper surface) indicates the direction in which ejection ports are arrayed in a print head 8, to be described later, and the z-direction indicates the vertical direction, respectively.

The printing apparatus 1 is a multi-function peripheral including a print unit 2 and a scanner unit 3 and capable of performing various kinds of processing relating to the printing operation and the reading operation by the print unit 2 and the scanner unit 3 individually, or in an interlocking manner of the print unit 2 and the scanner unit 3. The scanner unit 3 includes an ADF (Auto Document Feeder) and an FBS (Flat Bed Scanner) and is capable of reading of a document automatically fed by the ADF and reading (scanning) of a document placed on a document table of the FBS by a user. In the present embodiment, the multi-function peripheral having both the print unit 2 and the scanner unit 3 is described, but an aspect in which the scanner unit 3 is not included may be accepted. FIG. 1 shows a case where the printing apparatus 1 is in a standby state where the printing apparatus 1 is performing neither printing operation nor reading operation.

In the print unit 2, at the bottom in the vertically downward direction of a casing 4, a first cassette 5A and a second cassette 5B for storing a printing medium (cut sheet) S are installed detachably. In the first cassette 5A, comparatively small printing media up to the A4 size, and in the second cassette 5B, comparatively large printing media up to the A3 size are stored in a piled-up manner. In the vicinity of the first cassette 5A, a first feed unit 6A for feeding stored printing media by separating one by one is provided. Similarly, in the vicinity of the second cassette 5B, a second feed unit 6B is provided. In a case where the printing operation is performed, the printing medium S is selectively fed from one of the cassettes.

A conveyance roller 7, a discharge roller 12, a pinch roller 7*a*, a spur 7*b*, a guide 18, an inner guide 19, and a flapper 11 are conveyance mechanisms for guiding the printing medium S in a predetermined direction. The conveyance roller 7 is arranged on the upstream side and on the downstream side of the print head 8 and is a drive roller that is driven by a conveyance motor, not shown schematically. The pinch roller 7*a* is a follower roller that nips and rotates the printing medium S together with the conveyance roller 7. The discharge roller 12 is arranged on the downstream side of the conveyance roller 7 and is a drive roller that is driven by a conveyance motor, not shown schematically. The spur 7*b* sandwiches and conveys the printing medium S together with the conveyance roller 7 arranged on the downstream side of the print head 8 and the discharge roller 12.

The guide 18 is provided in the conveyance path of the printing medium S and guides the printing medium S in a predetermined direction. The inner guide 19 is a member extending in the y-direction and has a curved side surface, and guides the printing medium S along the side surface. The flapper 11 is a member for switching directions in which the printing medium S is conveyed at the time of the both-side printing operation. A discharge tray 13 is a tray for loading and holding the printing medium S for which the printing operation has been completed and which is discharged by the discharge roller 12.

The print head 8 is a color ink jet print head of full line type and in which a plurality of ejection ports from which ink is ejected in accordance with print data is arrayed along the y-direction in FIG. 1 so as to correspond to the width of the printing medium S. That is, the print head 8 is configured so as to be capable of ejecting inks of a plurality of colors. In a case where the print head 8 is at the standby position, an ejection port surface 8*a* of the print head 8 faces in the vertically downward direction and is capped by a cap unit 10 as in FIG. 1. In a case where the printing operation is performed, by a print controller 202, to be described later, the orientation of the print head 8 is changed so that the ejection port surface 8*a* faces a platen 9. The platen 9 is made up of a flat plate extending in the y-direction and supports the printing medium S from the rear side, for which the printing operation is performed by the print head 8. The movement of the print head 8 from the standby position to the printing position will be described later in detail.

An ink tank unit 14 stores four color inks to be supplied to the print head 8, respectively. Here, the four color inks refer to the inks of cyan (C), magenta (M), yellow (Y), and black (B). An ink supply unit 15 is provided on the way in the flow path connecting the ink tank unit 14 and the print head 8 and adjusts the pressure and the flow rate of the ink within the print head 8 to an appropriate range. In the present embodiment, a circulation-type ink supply system is adopted and the ink supply unit 15 adjusts the pressure of the ink supplied to the print head 8 and the flow rate of the ink collected from the print head 8 to an appropriate range.

A maintenance unit 16 includes the cap unit 10 and a wiping unit 17 and performs the maintenance operation for the print head 8 by causing these units to operate at predetermined timing. The maintenance operation will be explained later in detail.

<About Control Configuration of Printing Apparatus>

Figure 2:
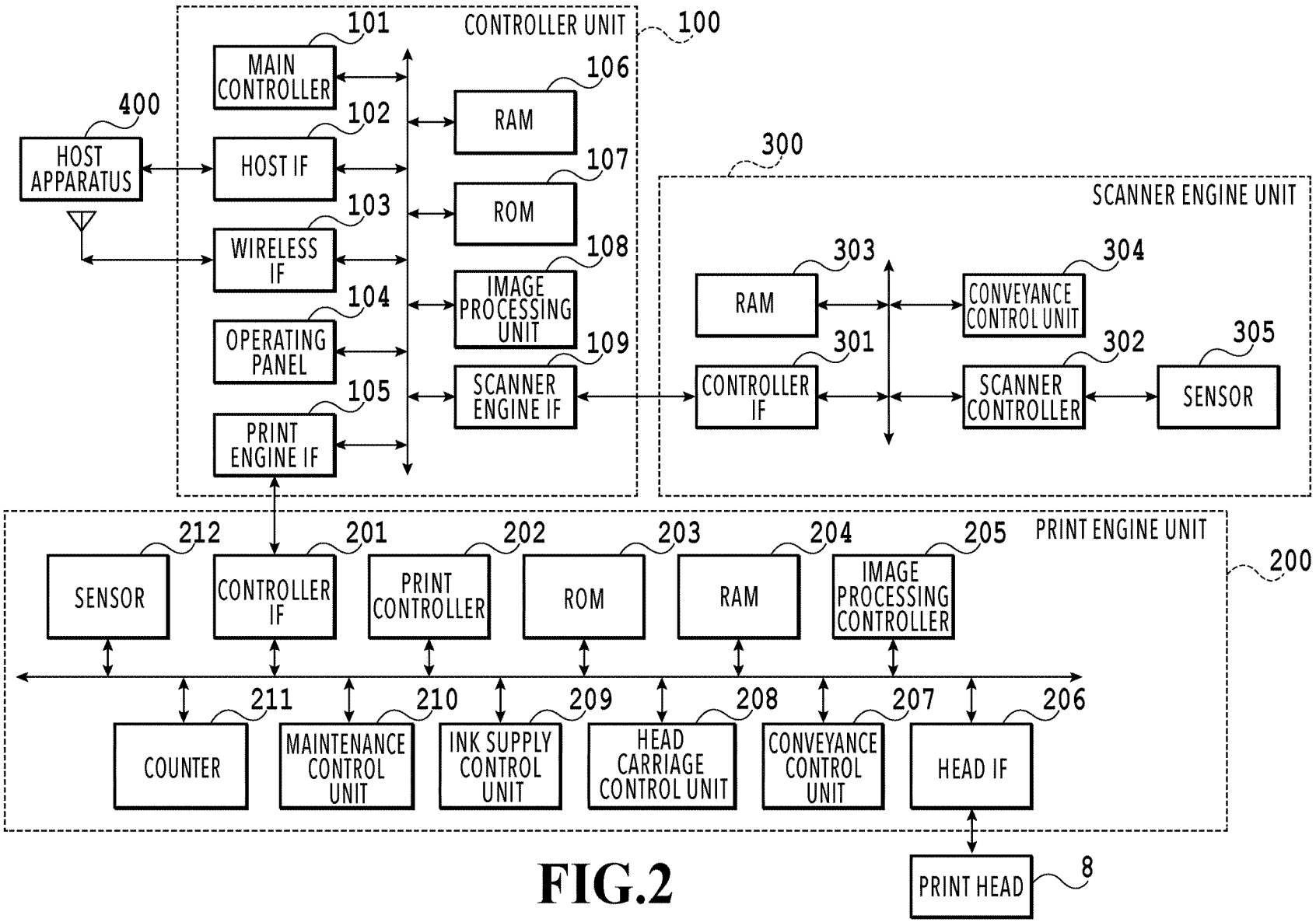
FIG. 2 is a block diagram showing a control configuration of the printing apparatus.

FIG. 2 is a block diagram showing a control configuration in the printing apparatus 1. The printing apparatus 1 mainly includes a print engine unit 200 configured to centralizedly control the print unit 2, a scanner engine unit 300 configured to centralizedly control the scanner unit 3, and a controller unit 100 configured to centralizedly control the entire printing apparatus 1. The print controller 202 controls various mechanisms of the print engine unit 200 in accordance with instructions of a main controller 101 of the controller unit 100. Various mechanisms of the scanner engine unit 300 are controlled by the main controller 101 of the controller unit 100. In the following, details of the control configuration are explained.

In the controller unit 100, the main controller 101 including a CPU controls the entire printing apparatus 1 by using a RAM 106 as a work area in accordance with programs and various parameters stored in a ROM 107. For example, in a case where a print job is input from a host apparatus 400 via a host I/F 102 or a wireless I/F 103, predetermined image processing is performed for image data received by an image processing unit 108 in accordance with instructions of the main controller 101. Then, the main controller 101 transmits the image data for which the image processing has been performed to the print engine unit 200 via a print engine I/F 105.

The printing apparatus 1 may acquire image data from the host apparatus 400 via wireless communication or wired communication, or may acquire image data from an external storage device (USB memory and the like) connected to the printing apparatus 1. The communication method that is made use of for wireless communication or wired communication is not limited. For example, as the communication method that is made use of for wireless communication, it is possible to apply Wi-Fi (Wireless Fidelity) (registered trademark) and Bluetooth (registered trademark). Further, as the communication method that is made use of for wired communication, it is possible to apply USB (Universal Serial Bus) and the like. Furthermore, for example, in a case where a reading command is input from the host apparatus 400, the main controller 101 transmits this command to the scanner engine unit 300 via a scanner engine I/F 109.

An operation panel 104 is a mechanism for a user to input and output for the printing apparatus 1. It is possible for a user to give instructions to perform an operation, such as a copy operation and a scan operation, to set a printing mode, to recognize information on the printing apparatus 1, and so on, via the operation panel 104. As described above, the operation panel 104 functions as a reception mechanism that receives a user input.

In the print engine unit 200, the print controller 202 including a CPU controls various mechanisms included in the print unit 2 by using a RAM 204 as a work area in accordance with programs and various parameters stored in a ROM 203. In a case where various commands and image data are received via a controller I/F 201, the print controller 202 temporarily saves them in the RAM 204. The print controller 202 causes an image processing controller 205 to convert the saved image data into print data so that the print head 8 can make use of for the printing operation. In a case where print data is generated, the print controller 202 causes the print head 8 to perform the printing operation based on the print data via a head I/F 206. At this time, the print controller 202 conveys the printing medium S by driving the feed units 6A and 6B, the conveyance roller 7, the discharge roller 12, and the flapper 11 shown in FIG. 1 via a conveyance control unit 207. In accordance with instructions of the print controller 202, the printing operation by the print head 8 is performed in an interlocking manner with the conveyance operation of the printing medium S and thus printing processing is performed.

A head carriage control unit 208 changes the orientation and position of the print head 8 in accordance with the operating state, such as the maintenance state and the printing state, of the printing apparatus 1. An ink supply control unit 209 controls the ink supply unit 15 so that the pressure of the ink supplied to the print head 8 is adjusted within an appropriate range. A maintenance control unit 210 controls the operation of the cleaning mechanism, such as the cap unit 10 and the wiping unit 17 in the maintenance unit 16.

In the scanner engine unit 300, the main controller 101 controls hardware resources of a scanner controller 302 by using the RAM 106 as a work area in accordance with programs and various parameters stored in the ROM 107. Due to this, various mechanisms included in the scanner unit 3 are controlled. For example, by the main controller 101 controlling the hardware resources within the scanner controller 302 via a controller I/F 301, a document mounted on the ADF by a user is conveyed via a conveyance control unit 304 and read by a sensor 305. Then, the scanner controller 302 saves the read image data in a RAM 303. It is possible for the print controller 202 to cause the print head 8 to perform the printing operation based on the image data read by the scanner controller 302 by converting the image data acquired as described above into print data.

<About Operation of Printing Apparatus in Printing State>

Figure 3:
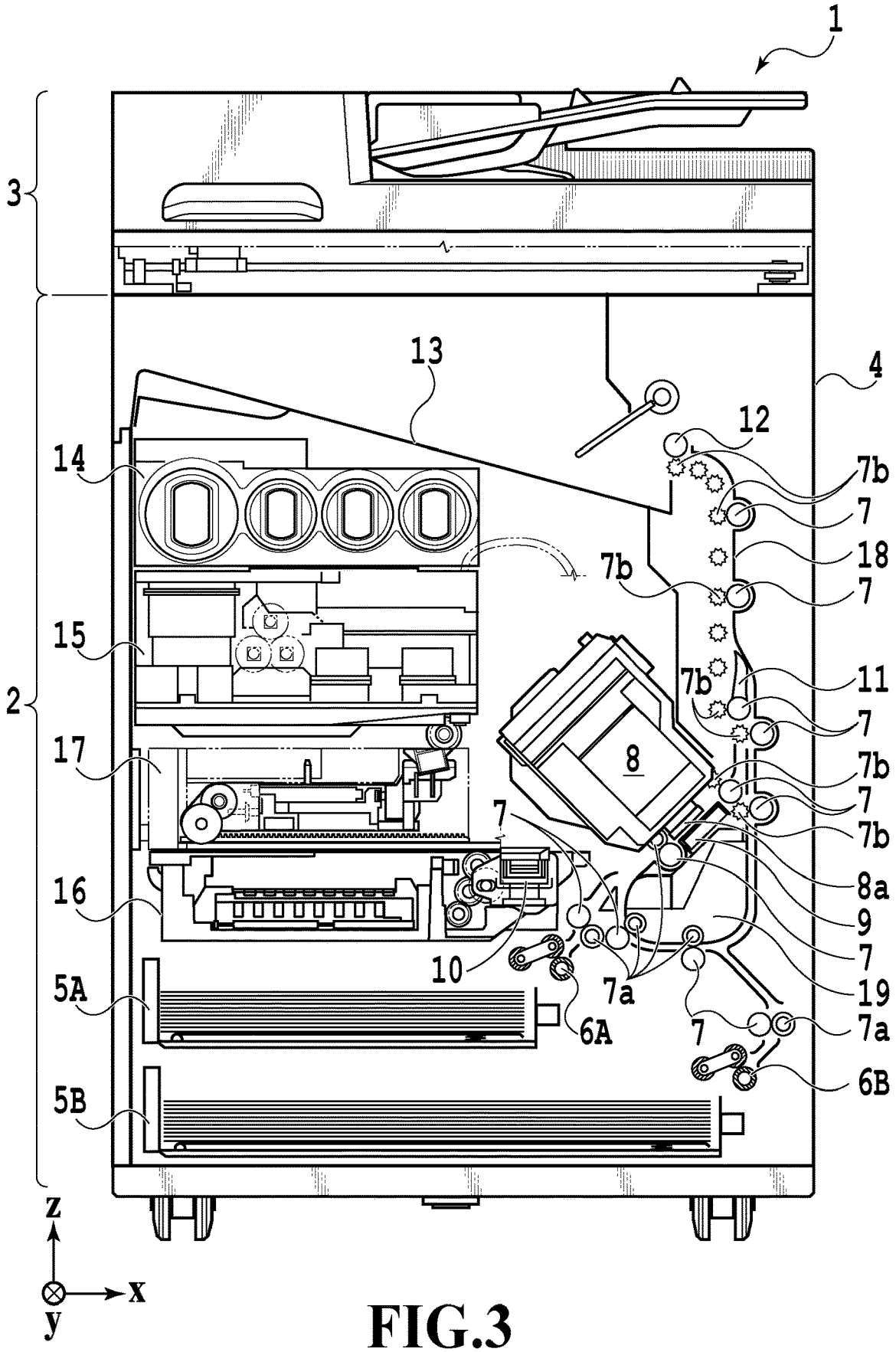
FIG. 3 is a diagram in a case where the printing apparatus is in a printing state.

FIG. 3 shows a case where the printing apparatus 1 is in the printing state. Compared to the standby state shown in FIG. 1, the cap unit 10 separates from the ejection port surface 8*a* of the print head 8 and the ejection port surface 8*a* faces the platen 9. In the present embodiment, the plane of the platen 9 is inclined about 45 degrees with respect to the horizontal direction and the ejection port surface 8*a* of the print head 8 at the printing position is also inclined about 45 degrees with respect to the horizontal direction so that the distance from the platen 9 is kept constant.

At the time of moving the print head 8 from the standby position shown in FIG. 1 to the printing position shown in FIG. 3, the print controller 202 lowers the cap unit 10 down to the evacuate position shown in FIG. 3 by using the maintenance control unit 210. Due to this, the ejection port surface 8*a* of the print head 8 separates from a cap member 10*a*. After this, the print controller 202 rotates the print head 8 by 45 degrees while adjusting the height in the vertical direction of the print head 8 by using the head carriage control unit 208 and causes the ejection port surface 8*a* to face the platen 9. In a case where the printing operation is completed and the print head 8 moves from the printing position to the standby position, the process opposite to that described above is performed by the print controller 202.

Next, the conveyance path of the printing medium S in the print unit 2 is explained. In a case where a print command is input, first, the print controller 202 moves the print head 8 to the printing position shown in FIG. 3 by using the maintenance control unit 210 and the head carriage control unit 208. After this, the print controller 202 drives one of the first feed unit 6A and the second feed unit 6B in accordance with the print command by using the conveyance control unit 207 and feeds the printing medium S.

Figure 4C:
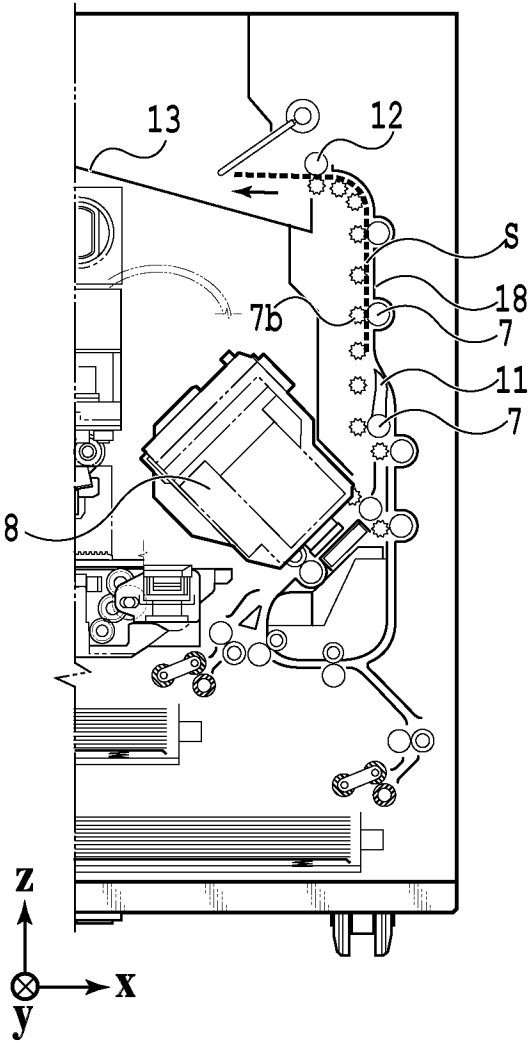
FIG. 4A to FIG. 4C are each a conveyance path diagram of a printing medium fed from a first cassette.
Figure 4B:
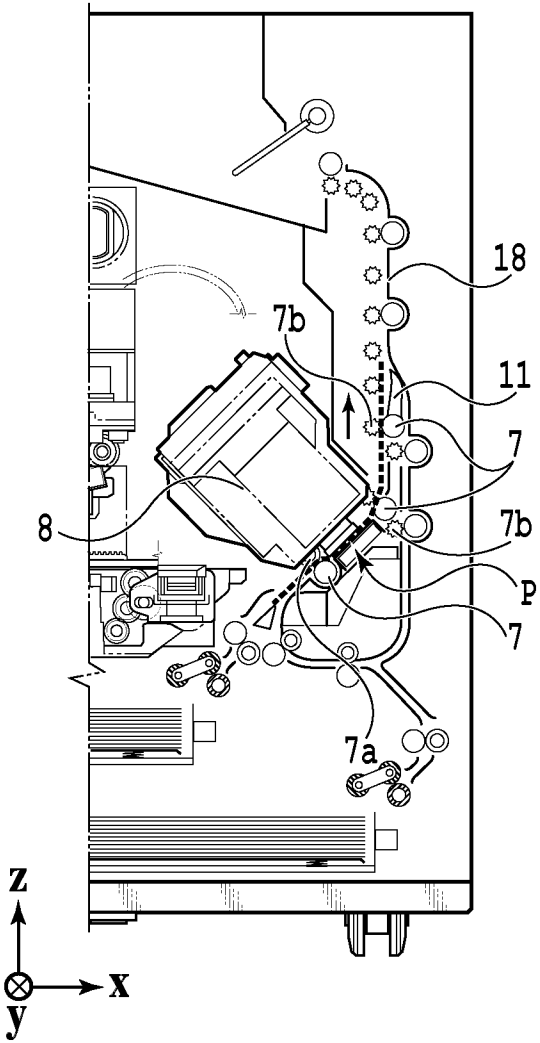
Figure 4A:
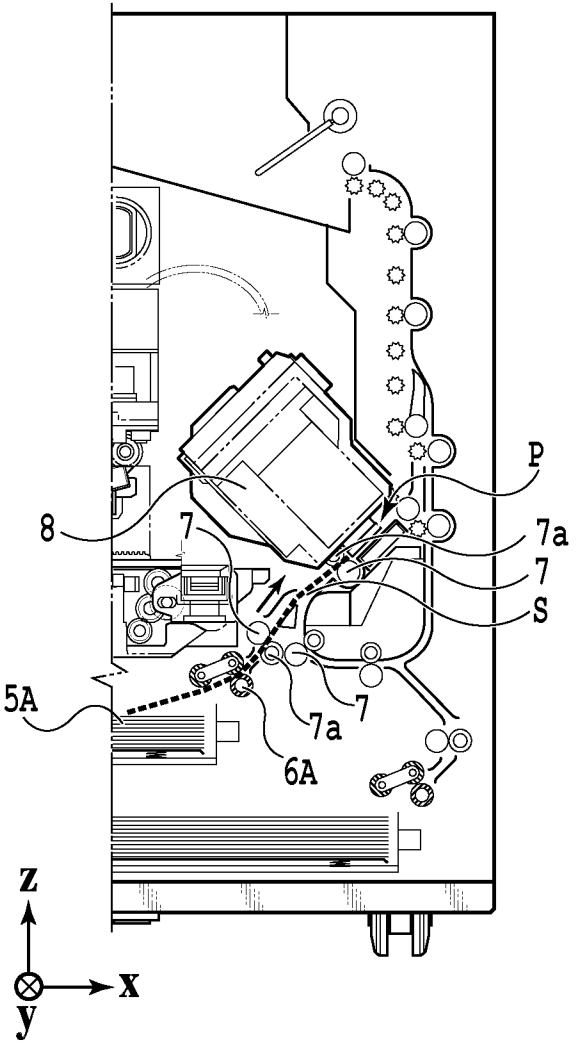

FIG. 4A to FIG. 4C are each a diagram showing a conveyance path in a case where the printing medium S of the A4 size stored in the first cassette 5A is fed. The printing medium S loaded on the top within the first cassette 5A is separated from the second and subsequent printing media by the first feed unit 6A and conveyed toward a printing area P between the platen 9 and the print head 8 while being nipped by the conveyance roller 7 and the pinch roller 7*a*. FIG. 4A shows the conveyance state immediately before the front end of the printing medium S reaches the printing area P. The advancement direction of the printing medium S is changed from the horizontal direction (x-direction) to the direction about 45 degrees inclined with respect to the horizontal direction before the printing medium S reaches the printing area P by being fed by the first feed unit 6A.

In the printing area P, ink is ejected toward the printing medium S from a plurality of ejection ports provided in the print head 8. The printing medium S in the area where ink is given is supported by the platen 9 at its rear side and the distance between the ejection port surface 8*a* and the printing medium S is kept constant. The printing medium S after ink is given passes the left side of the flapper 11 whose front end is inclined to the right and is conveyed in the vertically upward direction of the printing apparatus 1 along the guide 18 while being guided by the conveyance roller 7 and the spur 7*b*. FIG. 4B shows the state where the front end of the printing medium S passes the printing area P and is conveyed in the vertically upward direction. The advancement direction of the printing medium S is changed from the position of the printing area P about 45 degrees inclined with respect to the horizontal direction to the vertically upward direction by the conveyance roller 7 and the spur 7*b*.

After being conveyed in the vertically upward direction, the printing medium S is discharged to the discharge tray 13 by the discharge roller 12 and the spur 7*b*. FIG. 4C shows the state where the front end of the printing medium S passes the discharge roller 12 and is discharged to the discharge tray 13. The discharged printing medium S is held on the discharge tray 13 in the state where the side on which an image is printed by the print head 8 faces downward.

<About Maintenance Operation for Print Head>

Next, the maintenance operation for the print head 8 is explained. As also explained in FIG. 1, the maintenance unit 16 includes the cap unit 10 and the wiping unit 17 and performs the maintenance operation by causing these units to operate at predetermined timing.

Figure 5:
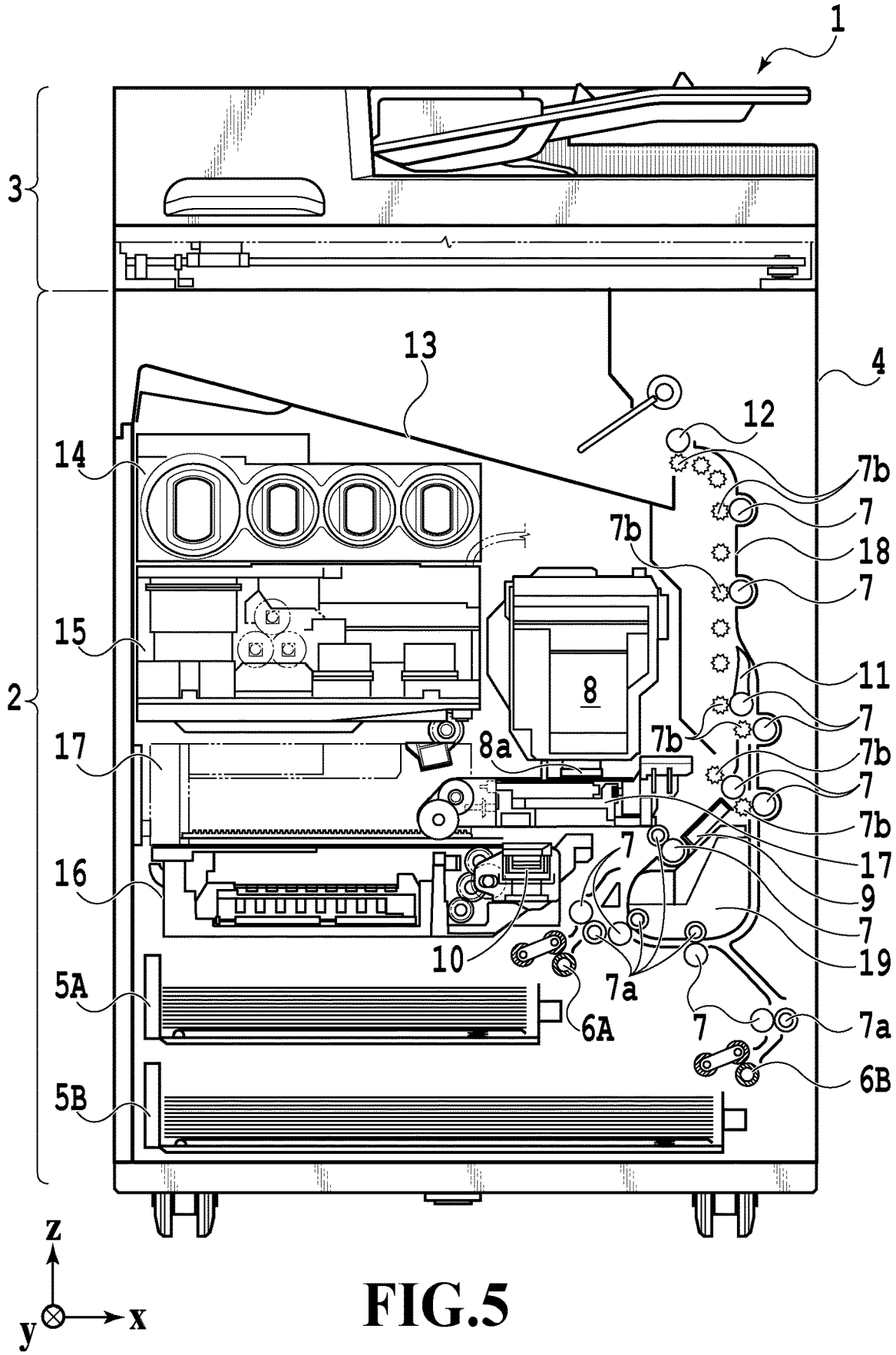
FIG. 5 is a diagram in a case where the printing apparatus is in a maintenance state.

FIG. 5 is a diagram in a case where the printing apparatus 1 is in the maintenance state. At the time of moving the print head 8 from the standby position shown in FIG. 1 to the maintenance position shown in FIG. 5, the print controller 202 moves the cap unit 10 in the vertically downward direction as well as moving the print head 8 upward in the vertical direction. Then, the print controller 202 moves the wiping unit 17 in the rightward direction in FIG. 5 from the evacuate position. After this, the print controller 202 moves the print head 8 in the vertically downward direction and moves the print head 8 to the maintenance position where the maintenance operation can be performed.

On the other hand, at the time of moving the print head 8 from the printing position shown in FIG. 3 to the maintenance position shown in FIG. 5, the print controller 202 moves the print head 8 in the vertically upward direction while rotating the print head 8 by 45 degrees. Then, the print controller 202 moves the wiping unit 17 in the rightward direction from the evacuate position. After this, the print controller 202 moves the print head 8 in the vertically downward direction and moves the print head 8 to the maintenance position where the maintenance operation by the maintenance unit 16 can be performed.

Figure 6A:
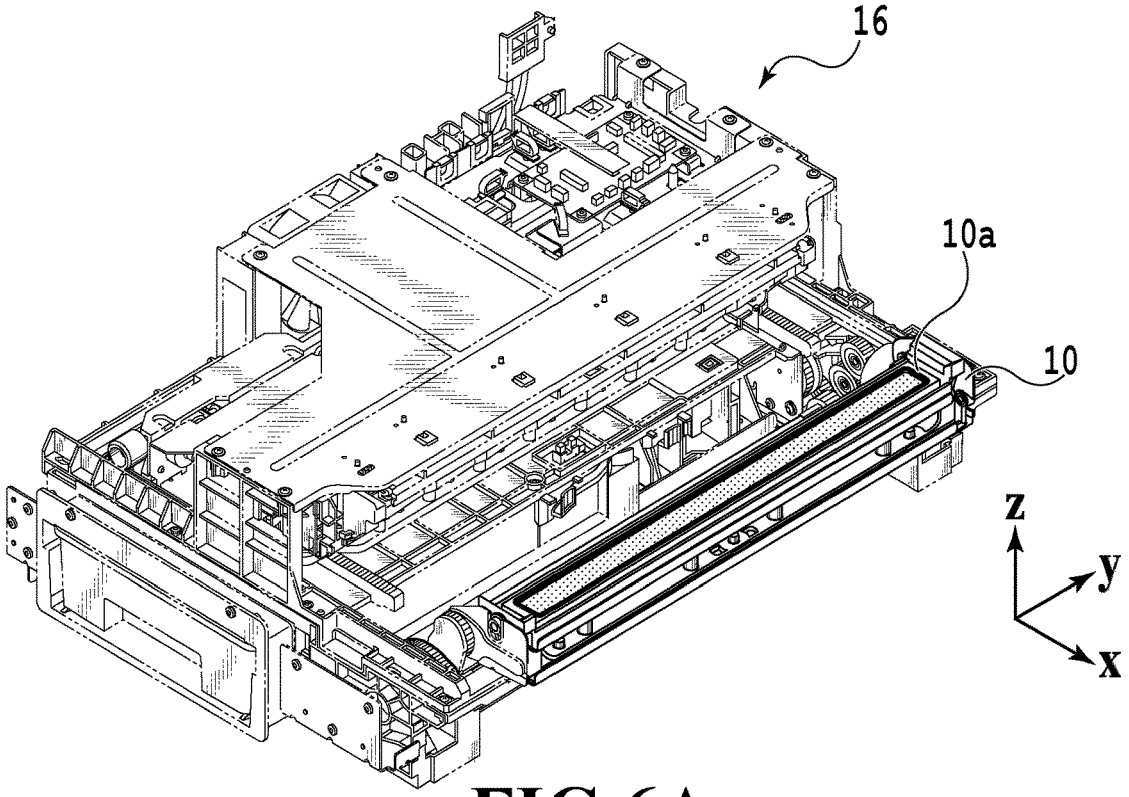
FIG. 6A and FIG. 6B are each a perspective diagram showing a configuration of a maintenance unit.
Figure 6B:
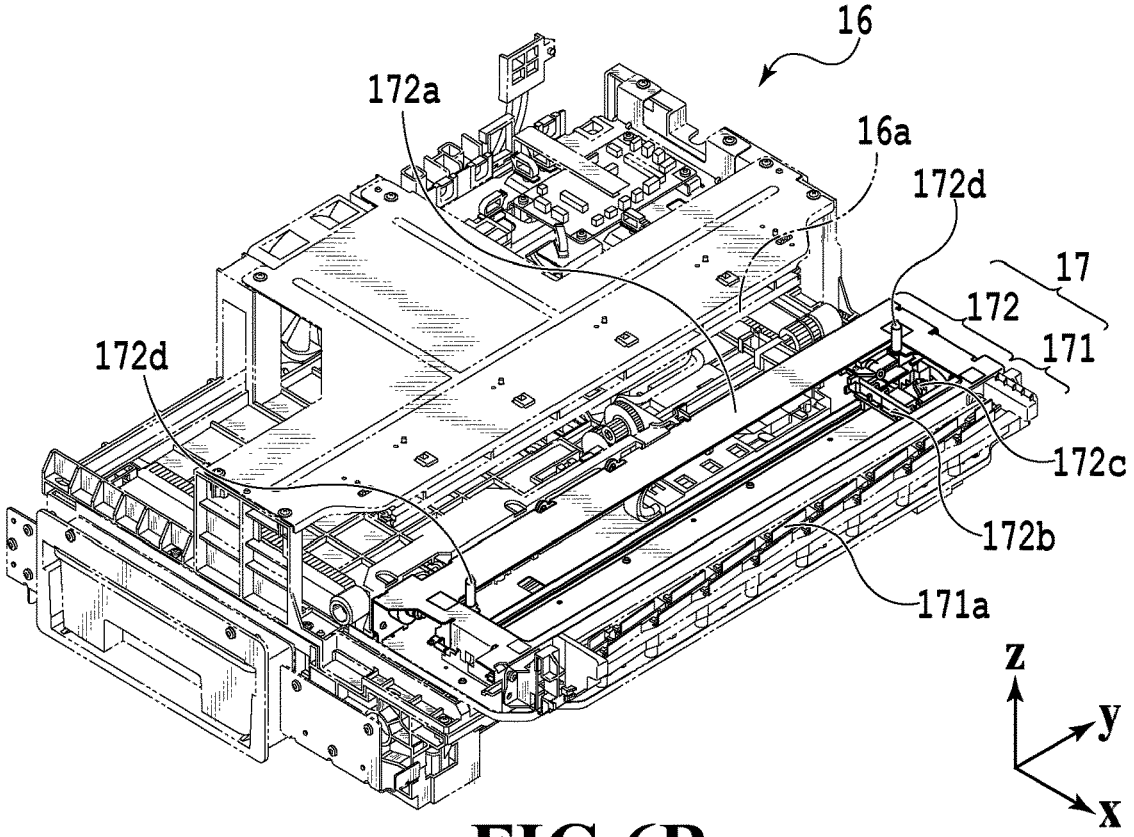

FIG. 6A is a perspective diagram showing a state where the maintenance unit 16 is at the standby position and FIG. 6B is a perspective diagram showing a state where the maintenance unit 16 is at the maintenance position. FIG. 6A corresponds to FIG. 1 and FIG. 6B corresponds to FIG. 5. In a case where the print head 8 is at the standby position, the maintenance unit 16 is at the standby position shown in FIG. 6A and the cap unit 10 has moved in the vertically upward direction and the wiping unit 17 is stored inside the maintenance unit 16. The cap unit 10 has the box-shaped cap member 10*a* extending in the y-direction and by causing the cap member 10*a* to adhere closely to the ejection port surface 8*a* of the print head 8, it is possible to suppress evaporation of ink from the ejection port. In the cap member 10*a*, an absorbent capable of absorbing and storing a predetermined amount of ink is arranged. Further, the cap unit 10 also includes a function to collect ink ejected by preparatory ejection and the like to the cap member 10*a* and to cause a suction pump, not shown schematically, to suck in the collected ink.

On the other hand, at the maintenance position shown in FIG. 6B, the cap unit 10 has moved in the vertically downward direction and the wiping unit 17 is pulled out from the maintenance unit 16. The wiping unit 17 includes two wiper units: a blade wiper unit 171 and a vacuum wiper unit 172.

In the blade wiper unit 171, blade wipers 171*a* for wiping the ejection port surface 8*a* along the x-direction are arranged in the y-direction so as to cover a length corresponding to an array area of the ejection ports. At the time of performing the wiping operation by using the blade wiper unit 171, the wiping unit 17 moves the blade wiper unit 171 in the x-direction in the state of being positioned at a height where the print head 8 is capable of coming into contact with the blade wiper 171*a*. By this movement, the ink or the like sticking to the ejection port surface 8*a* is wiped off by the blade wiper 171*a*.

At the entrance of the maintenance unit 16 at the time of the blade wiper 171*a* being stored, a wet wiper cleaner 16*a* for giving a wet liquid to the blade wiper 171*a* as well as removing ink sticking to the blade wiper 171*a* is arranged. Each time the blade wiper 171*a* is stored in the maintenance unit 16, sticking substances are removed by the wet wiper cleaner 16*a* and a wet liquid is applied. Then, at the time of wiping the ejection port surface 8*a* next, the wet liquid is transferred to the ejection port surface 8*a*, and thereby, smoothness between the ejection port surface 8*a* and the blade wiper 171*a* is improved.

On the other hand, the vacuum wiper unit 172 has a flat plate 172*a* having an opening extending in the y-direction, a carriage 172*b* capable of moving within the opening in the y-direction, and a vacuum wiper 172*c* mounted on the carriage 172*b*. The vacuum wiper 172*c* is arranged so as to be capable of wiping the ejection port surface 8*a* in the y-direction accompanying the movement of the carriage 172*b*. At the front end of the vacuum wiper 172*c*, a suction port connected to a suction pump, not shown schematically, is formed. Because of this, in a case where the carriage 172*b* is moved in the y-direction while causing the suction pump to operate, the ink or the like sticking to the ejection port surface 8*a* of the print head 8 is sucked into the suction port while being wiped and collected by the vacuum wiper 172*c*. At this time, a positioning pin 172*d* provided at both ends of the flat plate 172*a* and the opening is made use of for positioning the ejection port surface 8*a* for the vacuum wiper 172*c*.

It is possible for the wiping unit 17 to perform first wiping processing to perform the wiping operation by the blade wiper unit 171 but not to perform the wiping operation by the vacuum wiper unit 172 and second wiping processing to perform both pieces of wiping processing in order. At the time of performing the first wiping processing, the print controller 202 first pulls out the wiping unit 17 from the maintenance unit 16 in the state where the print head 8 is evacuated in the vertically upward direction from the maintenance position in FIG. 57. Then, the print controller 202 moves the wiping unit 17 into the maintenance unit 16 after moving the print head 8 in the vertically downward direction down to the position at which the print head 8 is capable of coming into contact with the blade wiper 171*a*. By this movement, the ink or the like sticking to the ejection port surface 8*a* is wiped off by the blade wiper 171*a*. That is, the blade wiper 171*a* wipes the ejection port surface 8*a* at the time of moving from the position where the blade wiper 171*a* is pulled out from the maintenance unit 16 into the maintenance unit 16.

After the blade wiper unit 171 is stored, next, the print controller 202 moves the cap unit 10 in the vertically upward direction and causes the cap member 10*a* to adhere closely to the ejection port surface 8*a* of the print head 8. Then, the print controller 202 drives the print head 8 in this state and causes the print head 8 to perform preparatory ejection and sucks in the ink collected into the cap member 10*a* by the suction pump.

On the other hand, at the time of performing the second wiping processing, first, the print controller 202 pulls out the wiping unit 17 from the maintenance unit 16 by sliding the wiping unit 17 in the state where the print head 8 is evacuated in the vertically upward direction from the maintenance position in FIG. 5. Then, the print controller 202 moves the wiping unit 17 into the maintenance unit 16 after moving the print head 8 in the vertically downward direction down to the position where the print head 8 is capable of coming into contact with the blade wiper 171*a*. Due to this, the wiping operation by the blade wiper 171*a* is performed for the ejection port surface 8*a*. Next, the print controller 202 pulls out the wiping unit 17 from the maintenance unit 16 by sliding the wiping unit 17 up to a predetermined position in the state where the print head 8 is evacuated in the vertically upward direction from the maintenance position in FIG. 5 again. Following the above, the print controller 202 performs positioning of the ejection port surface 8*a* and the vacuum wiper unit 172 by using the flat plate 172*a* and the positioning pin 172*d* while lowering the print head 8 down to the wiping position shown in FIG. 5. After this, the print controller 202 performs the wiping operation by the above-described vacuum wiper unit 172. After evacuating the print head 8 in the vertically upward direction and storing the wiping unit 17, the print controller 202 performs preparatory ejection into the cap member by the cap unit 10 and the suction operation of collected ink as in the first wiping processing.

<About Ink Supply Unit>

Figure 7:
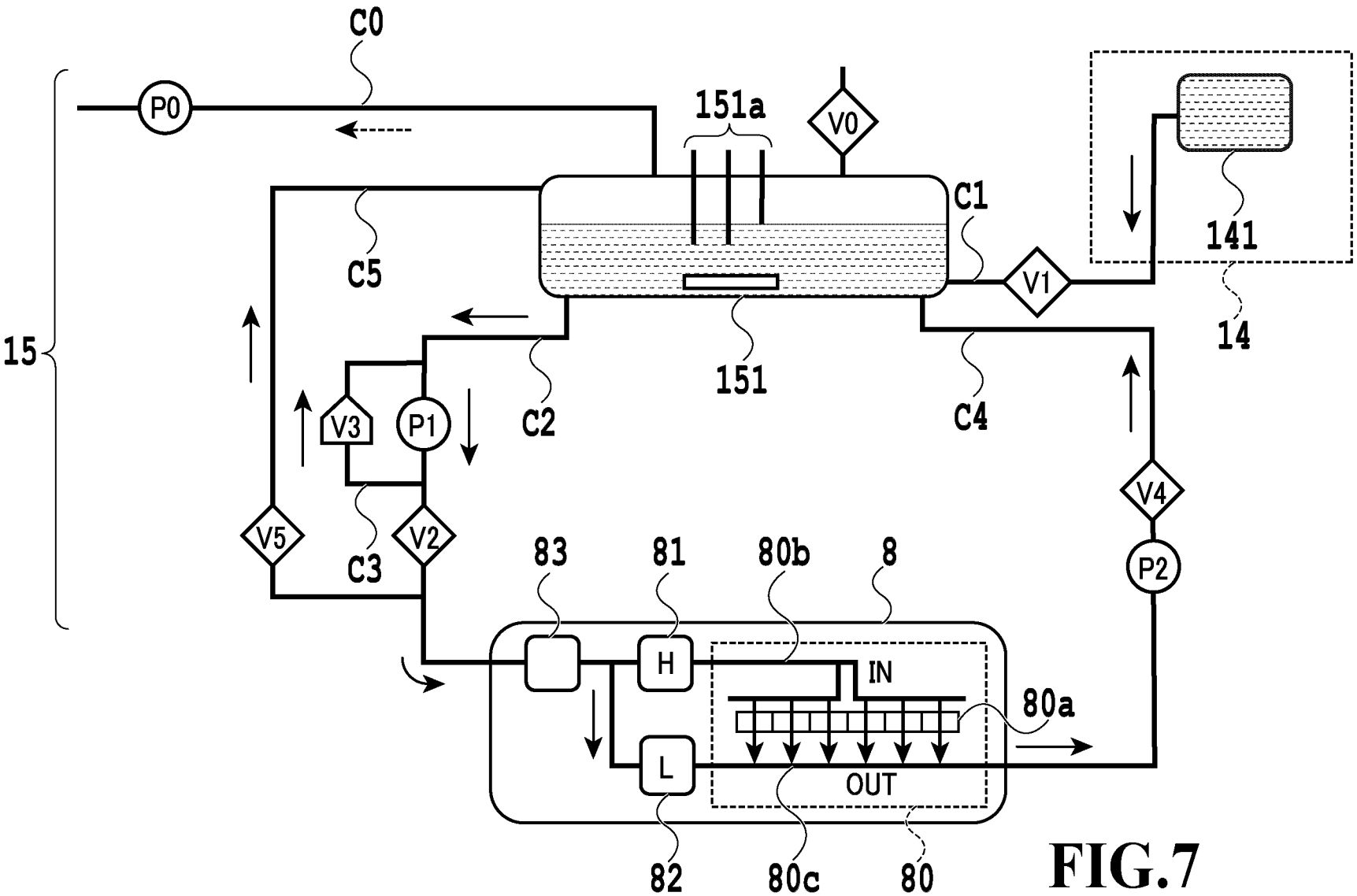
FIG. 7 is a diagram showing an ink supply unit.

FIG. 7 is a diagram including the ink supply unit 15 adopted in the ink jet printing apparatus 1 of the present embodiment. The flow path configuration of the ink circulation system of the present embodiment is explained by using FIG. 7. The ink supply unit 15 supplies ink supplied from the ink tank unit 14 to the print head 8 (head unit). In FIG. 7, the configuration of one color ink is shown, but in fact, such a configuration is prepared for each ink color. The ink supply unit 15 is controlled basically by the ink supply control unit 209 shown in FIG. 2. In the following, each configuration of the ink supply unit 15 is explained.

Ink circulates mainly between a sub tank 151 and the print head 8. In the print head 8, the ejection operation of ink is performed based on image data and the ink not ejected is collected again to the sub tank 151.

The sub tank 151 that stores a predetermined amount of ink is connected to a supply flow path C2 for supplying ink to the print head 8 and a collecting flow path C4 for collecting ink from the print head 8. That is, the circulation flow path (circulation path) through which ink circulates is made up of the sub tank 151, the supply flow path C2, the print head 8, and the collecting flow path C4. Further, the sub tank 151 is connected to a flow path C0 through which air flows.

In the sub tank 151, a liquid surface detection unit 151*a* including a plurality of electrode pins is provided. It is possible for the ink supply control unit 209 to grasp the height of the ink liquid surface, that is, the ink remaining amount within the sub tank 151 by detecting whether or not there is a conduction current between the plurality of pins. A decompression pump P0 (within-tank decompression pump) is a negative pressure generation source for decompressing the inside of the sub tank 151. An atmosphere open valve V0 is a valve for switching whether or not to cause the inside of the sub tank 151 to communicate with the atmosphere.

A main tank 141 is a tank storing ink that is supplied to the sub tank 151. The main tank 141 is made up of a flexible member and the sub tank 151 is filled with ink by a change in volume of the flexible member. The main tank 141 has a configuration detachable from the printing apparatus main body. On the way of a tank connection flow path C1 that connects the sub tank 151 and the main tank 141, a tank supply valve V1 for switching connections of the sub tank 151 and the main tank 141 is arranged.

In a case of detecting that the ink within the sub tank 151 becomes smaller than a predetermined amount by the liquid surface detection unit 151*a*, the ink supply control unit 209 closes the atmosphere open valve V0, a supply valve V2, a collecting valve V4, and a head exchange valve V5 and opens the tank supply valve V1. In this state, the ink supply control unit 209 causes the decompression pump P0 to operate. Then, the pressure inside the sub tank 151 becomes negative and ink is supplied from the main tank 141 to the sub tank 151. In a case of detecting that the ink within the sub tank 151 exceeds a predetermined amount by the liquid surface detection unit 151*a*, the ink supply control unit 209 closes the tank supply valve V1 and stops the decompression pump P0.

The supply flow path C2 is a flow path for supplying ink from the sub tank 151 to the print head 8 and on the way thereof, a supply pump P1 and the supply valve V2 are arranged. During the printing operation, by driving the supply pump P1 in the state where the supply valve V2 is open, it is possible to circulate ink in the circulation path while supplying ink to the print head 8. The amount of ink ejected per unit time by the print head 8 fluctuates in accordance with image data. The flow rate of the supply pump P1 is determined so as to be compatible also with a case where the print head 8 performs the ejection operation that maximizes the amount of ink to be consumed per unit time.

A relief flow path C3 is a flow path that is located on the upstream side of the supply valve V2 and which connects the upstream side and the downstream side of the supply pump P1. On the way of the relief flow path C3, a relief valve V3, which is a differential pressure valve, is arranged. The relief valve is not opened or closed by a drive mechanism but is spring-biased and configured so as to open in a case where a predetermined pressure is reached. For example, in a case where the ink supply amount per unit time from the supply pump P1 is larger than the total value of the ejection amount per unit time of the print head 8 and the flow rate (amount of ink to be drawn) per unit time of the collecting pump P2, the relief valve V3 is opened in accordance with the pressure that is exerted on the relief valve V3 itself. Due to this, a circulation flow path made up of a part of the supply flow path C2 and the relief flow path C3 is formed. By providing the configuration of the relief flow path C3, the ink supply amount for the print head 8 is adjusted in accordance with the ink consumption in the print head 8, and therefore, it is possible to stabilize the pressure within the circulation path irrespective of image data.

The collecting flow path C4 is a flow path for collecting ink from the print head 8 to the sub tank 151 and on the way thereof, a collecting pump P2 and the collecting valve V4 are arranged. At the time of circulating ink within the circulation path, the collecting pump P2 functions as a negative pressure generation source to suck in ink from the print head 8. By the drive of the collecting pump P2, an appropriate pressure difference arises between an IN flow path 80*b* and an OUT flow path 80*c* within the print head 8, and therefore, it is possible to circulate ink between the IN flow path 80*b* and the OUT flow path 80*c*.

The collecting valve V4 is a valve for checking a backflow in a case where the printing operation is not being performed, that is, ink is not being circulated within the circulation path. In the circulation path of the present embodiment, the sub tank 151 is arranged above the print head 8 in the vertical direction (see FIG. 1). Because of this, in a case where the supply pump P1 and the collecting pump P2 are not driven, there is a possibility that ink flows backward from the sub tank 151 to the print head 8 due to a water head difference between the sub tank 151 and the print head 8. In order to check such a backflow, in the present embodiment, the collecting valve V4 is provided in the collecting flow path C.

The supply valve V2 also functions as a valve for preventing supply of ink from the sub tank 151 to the print head 8 in a case where the printing operation is not being performed, that is, ink is not being circulated within the circulation path.

A head exchange flow path C5 is a flow path that connects the supply flow path C2 and an air chamber (space where ink is not stored) of the sub tank 151 and on the way thereof, the head exchange valve V5 is arranged. One end of the head exchange flow path C5 is connected to the upstream of the print head 8 in the supply flow path C2 and connected to the downstream side of the supply valve V2. The other end of the head exchange flow path C5 is connected to the upper portion of the sub tank 151 and communicates with the air chamber inside the sub tank 151. The head exchange flow path C5 is made use of in a case where ink is drawn out from the print head 8 in use, such as at the time of exchanging the print head 8 or transporting the printing apparatus 1. The head exchange valve V5 is controlled by the ink supply control unit 209 so as to close except for a case where the print head 8 is filled with ink and a case where ink is collected from the print head 8. Further, the supply valve V2 is provided between the connection portion with the head exchange flow path C5 and the connection portion with the relief flow path C3 in the supply flow path C2.

Next, the flow path configuration within the print head 8 is explained. The ink supplied to the print head 8 by the supply flow path C2 is supplied to a first negative pressure control unit 81 and a second negative pressure control unit 82 after passing a filter 83. In the first negative pressure control unit 81, the control pressure is set to a weak negative pressure (negative pressure whose pressure difference from the atmospheric pressure is small). In the second negative pressure control unit 82, the control pressure is set to a strong negative pressure (negative pressure whose pressure difference from the atmospheric pressure is large). The pressures in the first negative pressure control unit 81 and in the second negative pressure control unit 82 are generated in an appropriate range by the drive of the collecting pump P2.

In an ejection unit 80, a plurality of printing element substrates 80*a* on which a plurality of ejection ports is arrayed is arranged and a long ejection port row is formed. The common supply flow path 80*b* (IN flow path) for guiding ink supplied by the first negative pressure control unit 81 and the common collecting flow path 80*c* (OUT flow path) for guiding ink supplied by the second negative pressure control unit 82 are also extending in the array direction of the printing element substrate 80*a*. Further, on the individual printing element substrate 80*a*, an individual supply flow path connected with the common supply flow path 80*b* and an individual collecting flow path connected with the common collecting flow path 80*c* are formed. Because of this, on the individual printing element substrate 80*a*, a flow of ink is generated, which flows in from the common supply flow path 80*b* where the negative pressure is relatively weak and flows out to the common collecting flow path 80*c* where the negative pressure is relatively strong. In the path of the individual supply flow path and the individual collecting flow path, a pressure chamber that communicates with each ejection port and which is filled with ink is provided and a flow of ink occurs also at the ejection port and in the pressure chamber where printing is not being performed. In a case where the ejection operation is performed on the printing element substrate 80*a*, a part of the ink that moves from the common supply flow path 80*b* to the common collecting flow path 80*c* is consumed by being ejected from the ejection port, but the ink that is not ejected moves to the collecting flow path C4 via the common collecting flow path 80*c*.

<About Ejection Unit>

Figure 8A:
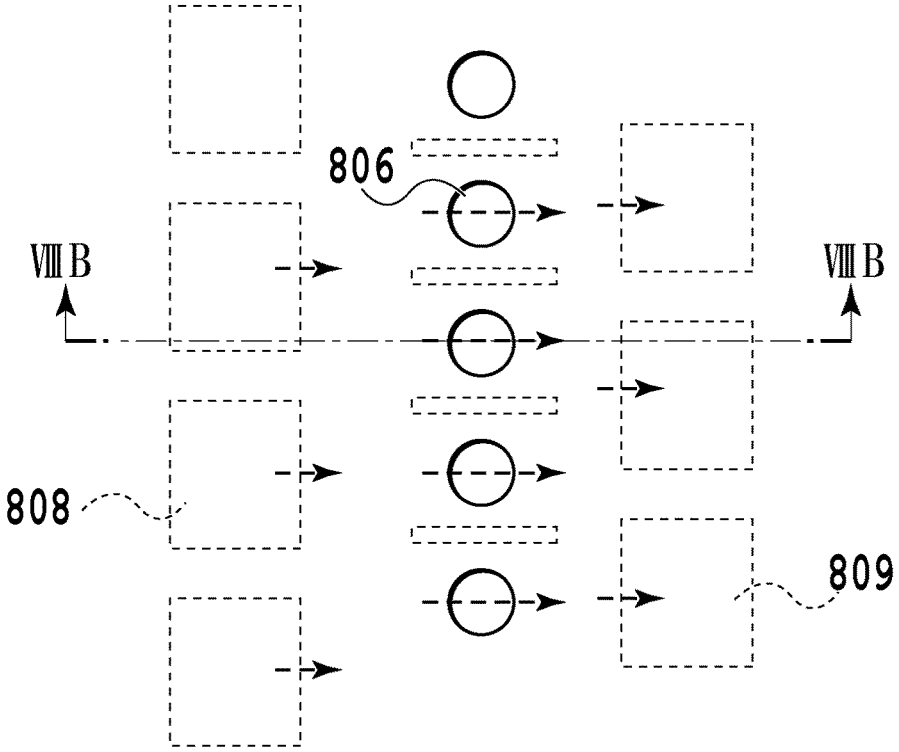
FIG. 8A and FIG. 8B are each a diagram showing a configuration of an ejection unit of a printing element substrate.
Figure 8B:
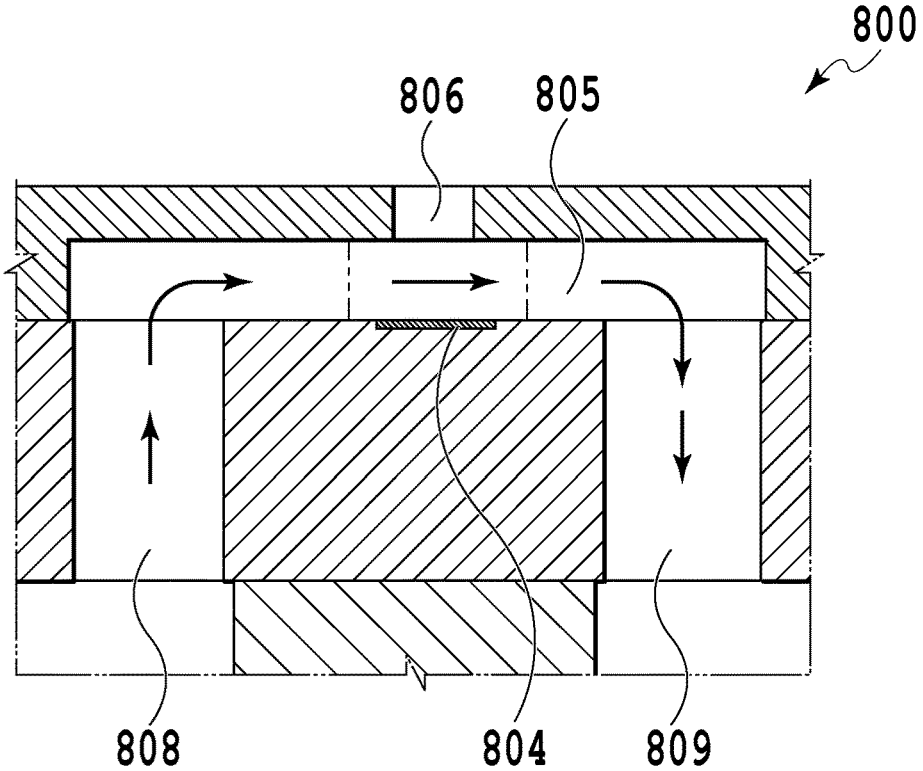

FIG. 8A is a planar schematic diagram in which a part of the printing element substrate 80*a* is enlarged and FIG. 8B is a sectional schematic diagram at a section line VIIIb-VIIIb in FIG. 8A. On the printing element substrate 80*a*, a pressure chamber 805 filled with ink and an ejection port 806 that ejects ink are provided. In the pressure chamber 805, at the position facing the ejection port 806, a printing element 804 is provided. Further, on the printing element substrate 80*a*, an individual supply flow path 808 connected with the common supply flow path 80*b* and an individual collecting flow path 809 connected with the common collecting flow path 80*c* are formed in plurality, respectively, for each ejection port 806.

With the above-described configuration, on the printing element substrate 80*a*, a flow of ink is generated, which flows in from the common supply flow path 80*b* where the negative pressure is relatively weak (absolute value of pressure is high) and flows out to the common collecting flow path 80*c* where the negative pressure is relatively strong (absolute value of pressure is low). In more detail, ink flows in the order of the common supply flow path 80*b* the individual supply flow path 808 the pressure chamber 805 the individual collecting flow path 809 the common collecting flow path 80*c*. In a case where ink is ejected by the printing element 804, part of the ink moving from the common supply flow path 80*b* to the common collecting flow path 80*c* is discharged to the outside of the print head 8 by being ejected from the ejection port 806. On the other hand, the ink that is not ejected from the ejection port 806 is collected to the collecting flow path C4 via the common collecting flow path 80*c*.

With the above configuration, in a case where the printing operation is performed, the ink supply control unit 209 closes the tank supply valve V1 and the head exchange valve V5, opens the atmosphere open valve V0, the supply valve V2, and the collecting valve V4, and drives the supply pump P1 and the collecting pump P2. Due to this, a circulation path of the sub tank 151 the supply flow path C2 the print head 8 the collecting flow path C4 the sub tank 151 is established. In a case where the ink supply amount per unit time from the supply pump P1 is larger than the total value of the ejection amount per unit time of the print head 8 and the flow rate per unit time in the collecting pump P2, ink flows into the relief flow path C3 from the supply flow path C2. Due to this, the flow rate of the ink that flows into the print head 8 from the supply flow path C2 is adjusted.

In a case where the printing operation is not being performed, the ink supply control unit 209 stops the supply pump P1 and the collecting pump P2 and closes the atmosphere open valve V0, the supply valve V2, and the collecting valve V4. Due to this, the flow of ink within the print head 8 stops and a backflow due to the water head difference between the sub tank 151 and the print head 8 is suppressed. Further, by closing the atmosphere open valve V0, leakage of ink and evaporation of ink from the sub tank 151 are suppressed.

In a case of collecting ink from the print head 8, the ink supply control unit 209 closes the atmosphere open valve V0, the tank supply valve V1, the supply valve V2, and the collecting valve 4, opens the head exchange valve V5, and drives the decompression pump P0. Due to this, the inside of the sub tank 151 enters a negative pressure state and the ink within the print head 8 is collected to the sub tank 151 via the head exchange flow path C5. As described above, the head exchange valve V5 is a valve that is closed in the normal printing operation and at the time of standby and opened at the time of collecting ink from the print head 8. The head exchange valve V5 is also opened at the time of filling the head exchange flow path C5 with ink in a case where the print head 8 is filled. In the following, based on the basic configuration explained so far, preferred embodiments of the present invention are explained.

<About Post-Job Periodic Recovery Sequence>

Figure 9:
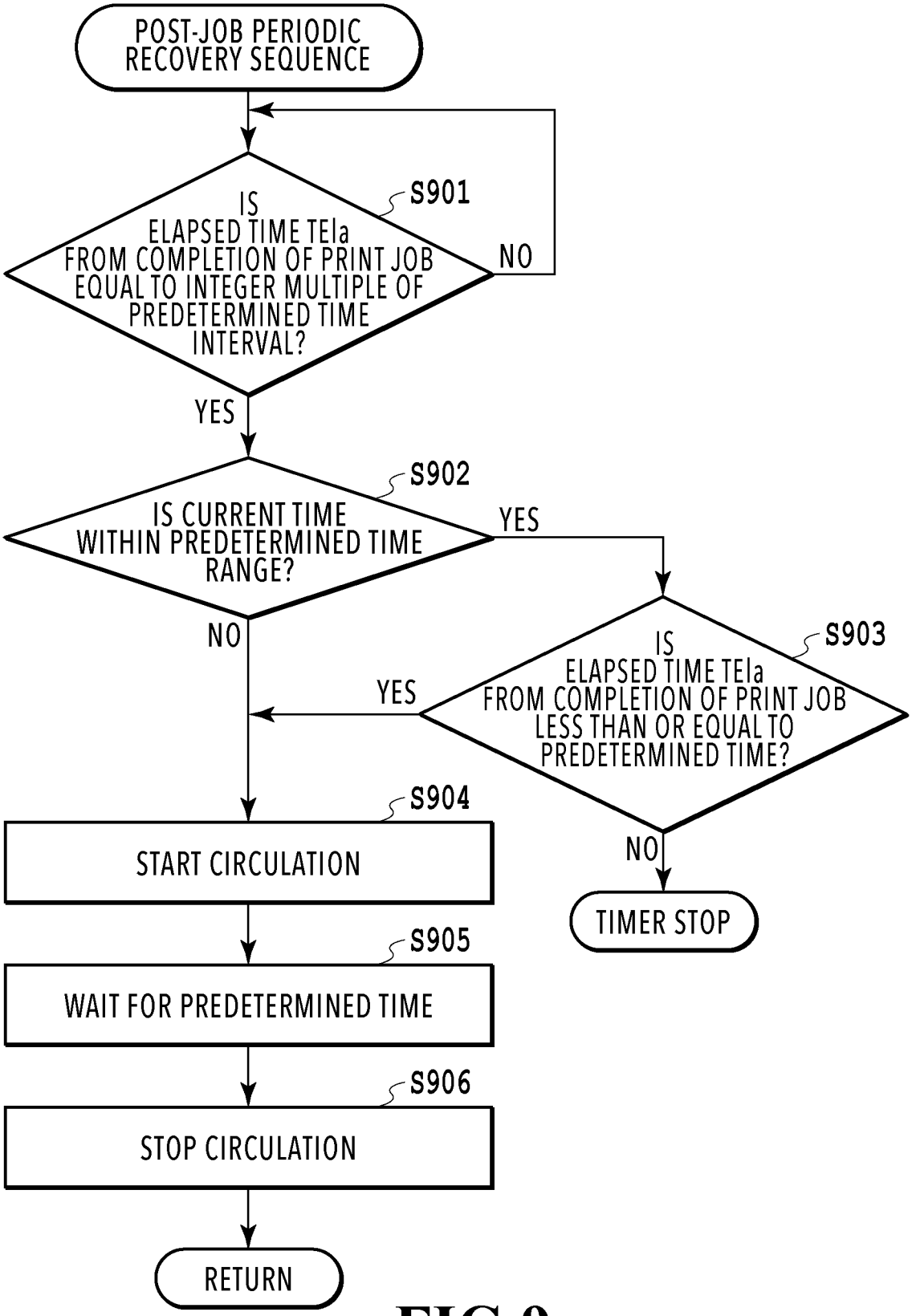
FIG. 9 is a flowchart of a post-job periodic recovery sequence.
Figure 10:
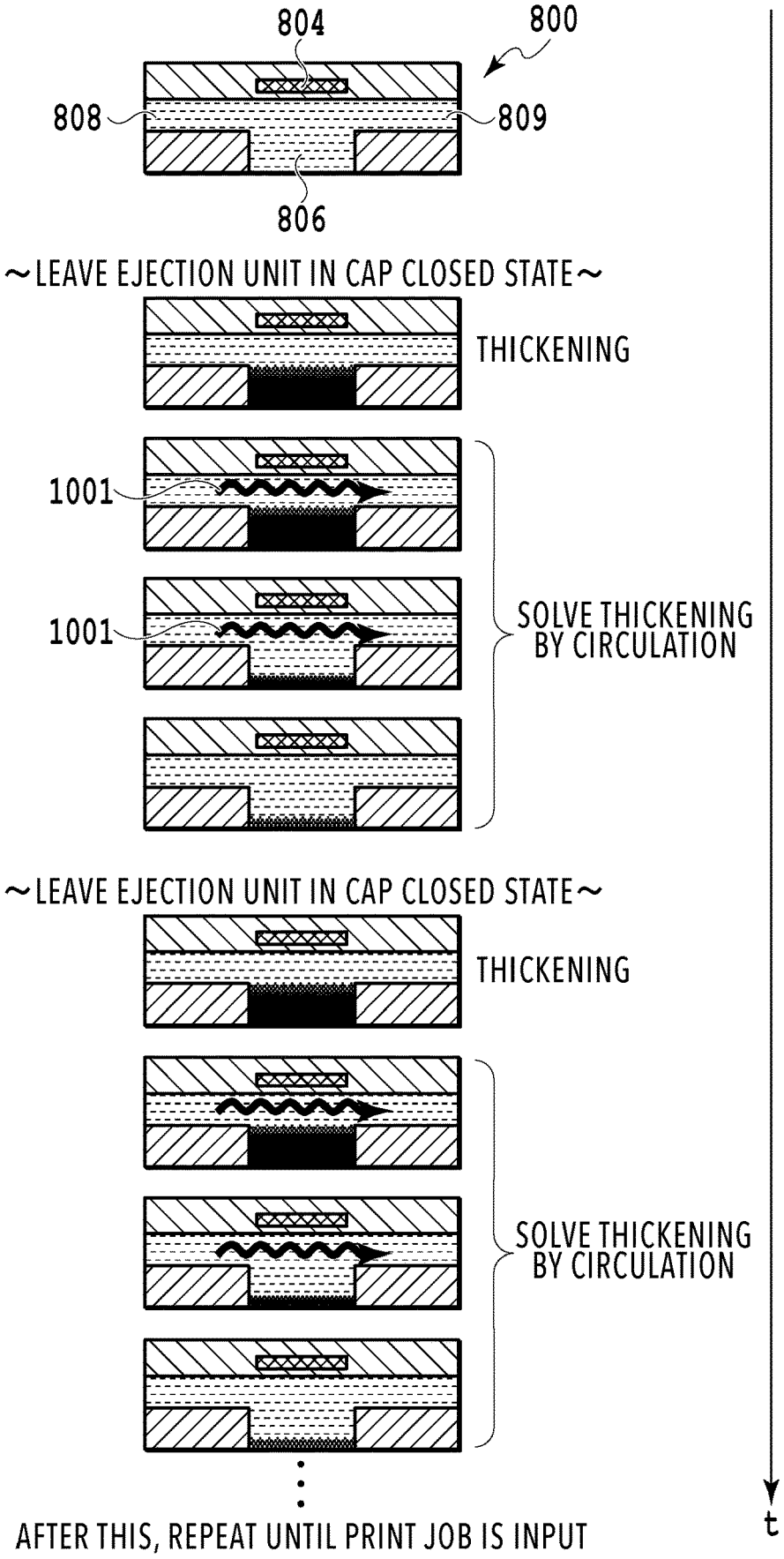
FIG. 10 is an explanatory diagram of periodic circulation.

In the following, a series of processing (referred to as post-job periodic recovery sequence) to recover ejection stability (at the ejection port 806) of an ejection unit 800, which is performed periodically after a print job is completed, is explained by using FIG. 9 and FIG. 10. The ejection stability means a characteristic capable of stably ejecting ink from an ejection port.

At step S901 (hereinafter, "step S-" is described simply as "S-"), the main controller 101 determines whether a time (referred to as elapsed time $T_{Ela}$) that has elapsed after a print job is completed satisfies equation (1) below. The elapsed time $T_{Ela}$ is counted by a timer of the controller unit 100. The timer that counts the elapsed time $T_{Ela}$ is reset at the time of execution of a print job. In a case where a print job is performed, ink circulation is performed accompanying the execution. The job not accompanied by ink circulation because printing is not performed, such as a job to transmit a facsimile and a scan job, is not included in a print job. Consequently, at the time of execution of such a job, the timer that counts the elapsed time $T_{Ela}$ is not reset.

[Mathematical equation 1]

$$T_{Ela}=\text{Int}\times N \quad \text{equation (1)}$$

In equation (1), Int indicates a predetermined time interval, in detail, indicates an interval of ink circulation performed periodically for the purpose of preventing ink non-discharge and one value, such as 30 minutes and 60 minutes, is set arbitrarily by a designer. It may also be possible to enable a user to change the value of the time interval within an allowable range. Further, N indicates an arbitrary integer. In a case where determination results at this step are affirmative, the processing advances to S902. On the other hand, in a case where the determination results at this step are negative, the processing returns to S901.

At S902, the main controller 101 determines whether the current time is within a predetermined time range. The predetermined time range is a time range whose start time and end time can be specified by a user via the operation panel 104 or the like. The current time is derived based on the time counted by the timer of the controller unit 100 and data relating to the predetermined time range is stored in the ROM 107. It is possible for a user to arbitrarily set the start time and the end time for specifying the predetermined time range. For example, a user sets a time zone (21:00 to 8:00 next day, and the like) that is not business hours as the predetermined time range. In a case where determination results at S902 are affirmative, the processing advances to S903 and on the other hand, in a case where the determination results are negative, the processing advances to S904. For the predetermined time range, an aspect is considered in which a user specifies only the start time for the fixed time range (for example, 12 hours or the like) in place of a user specifying the start time and the end time. In this aspect, the fixed time during which the periodic circulation is suspended is secured, and therefore, it is possible to suppress an increase in power consumption in the sleep state of the printing apparatus 1. This aspect is useful because of satisfying the standard in Europe and the like where the upper limit of power consumption per day is set.

At S903, the main controller 101 determines whether the elapsed time $T_{Ela}$ described previously is less than or equal to a predetermined time. As the predetermined time used at this step, one value, such as 90 minutes, is set arbitrarily by a designer. However, it may also be possible to enable a user to change or set the value of the predetermined time via the operation panel 104 within an allowable range. In a case where determination results at this step are affirmative, the processing advances to S904. On the other hand, in a case where the determination results at this step are negative, the print controller 202 stops the timer that counts the elapsed time $T_{Ela}$. This timer is resumed in a case where a print job is performed again.

At S904, the print controller 202 starts ink circulation within the circulation path described above by controlling the ink supply control unit 209. Due to this, an ink flow occurs in the ejection unit 800 within the print head 8. FIG. 10 shows the way the thickened ink having stagnated within the ejection port 806 flows out from the individual collecting flow path 809 by an ink flow 1001 having occurred at this step. The vertical axis in FIG. 10 is the time axis and time elapses from top to bottom. As shown in FIG. 10, by the ink flow 1001 that occurs each time a predetermined time elapses, the ink having stagnated within the ejection port 806 diffuses and the inside of the ejection port 806 is filled with fresh ink. As a result of this, the ejection stability (at the ejection port 806) of the ejection unit 800 is recovered.

At S905, the main controller 101 stands by for a predetermined time. Due to this, ink circulation is performed continuously for a predetermined time. As the predetermined time used at this step, one value, such as three seconds, is set arbitrarily by a designer. It is possible to use the timer that counts the current time, which the controller unit 100 has, for counting the standby time at this step.

At S906, the ink supply control unit 209 stops the ink circulation. Specifically, the ink supply control unit 209 stops the supply pump P1 and the collecting pump P2 and closes the atmosphere open valve V0, the supply valve V2, and the collecting valve V4. Due to this, the ink circulation stops and the backflow due to the water head difference between the sub tank 151 and the print head 8 is also suppressed. Further, by closing the atmosphere open valve V0, leakage of ink and evaporation of ink from the sub tank 151 are suppressed. The above is the contents of the post-job periodic recovery sequence in the present embodiment.

<About Predetermined-Time Stir Sequence>

In the following, a series of processing (referred to as predetermined-time stir sequence) to stir ink within the circulation path at a predetermined time is explained by using FIG. 11A and FIG. 11B.

Figure 11A:
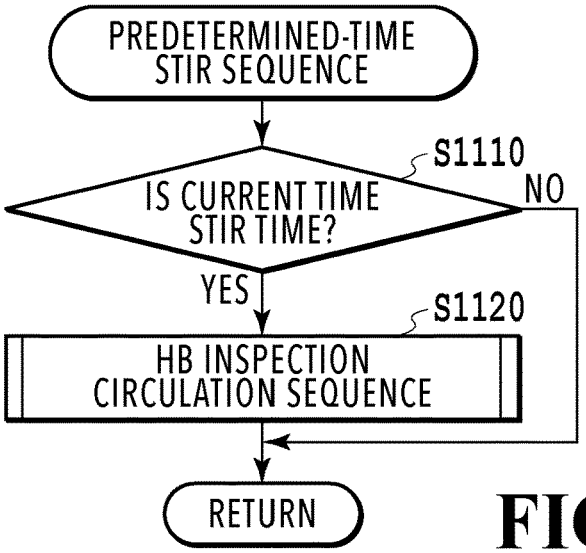
FIG. 11A and FIG. 11B are each a flowchart of a periodic stirring sequence.

First, a rough flow of the predetermined-time stir sequence is explained by using FIG. 11A. FIG. 11A is a flowchart showing a rough flow of the predetermined-time stir sequence.

At S1110, the main controller 101 determines whether the current time is a specified time (specified time at which stir is performed, referred to as a stir time). As the stir time used at this step, a default time (for example, a time 30 minutes before the end time of the periodic circulation suspension period (that is, business start time), 7:30 in this case) is set. However, it may also be possible to enable a user to change the time set as a default.

At S1120, the main controller 101 performs a series of processing (referred to as heater board (HB) inspection circulation sequence) to inspect whether or not it is possible for the ejection unit 800 to perform ejection normally while performing ink circulation. Details of the HB inspection circulation sequence will be described later. The above is the contents of a rough flow of the predetermined-time stir sequence.

Figure 11B:
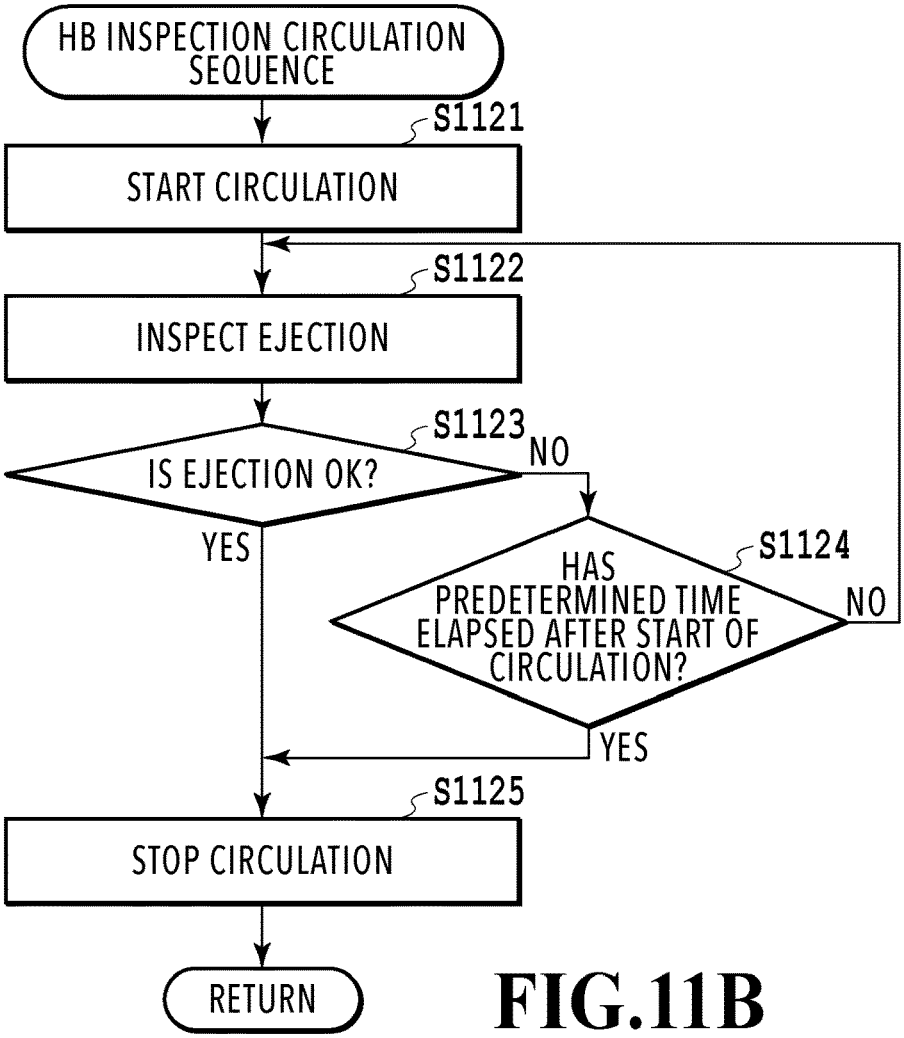

Following the above, the HB inspection circulation sequence (S1120 in FIG. 11A) is explained in detail by using FIG. 11B. FIG. 11B is a detailed flowchart of the HB inspection circulation sequence.

At S1121, the print controller 202 starts ink circulation within the circulation path by controlling the ink supply control unit 209. Due to this, an ink flow occurs in the ejection unit 800 within the print head 8. An attempt is made to recover the ejection stability as shown in FIG. 10 by causing an ink flow to occur at this step.

At S1122, the print controller 202 performs processing (referred to as ejection inspection processing) to inspect whether it is possible for the ejection unit 800 to eject ink normally. In the ejection inspection processing, by a temperature detecting element arranged between the printing element 804, which is a heating element, and a wire detecting the behavior of temperature at the time of pulse application, inspection of whether it is possible for the ejection unit 800 to eject ink normally (whether the ejection port 806 is not in the ink non-charge state) is performed.

At S1123, the print controller 202 determines whether it is possible for the ejection unit 800 to eject ink normally based on the results of the ejection inspection processing at S1122. In a case where the determination results at this step are affirmative, the processing advances to S1125. On the other hand, in a case where the determination results at this step are negative, the processing advances to S1124.

At S1124, the main controller 101 determines whether a predetermined time has elapsed after the start of the ink circulation at S1121. As the predetermined time used at this step, one value, such as 60 seconds, is set arbitrarily by a designer. In a case where determination results at this step are affirmative, the processing advances to S1125. On the other hand, in a case where the determination results at this step are negative, the processing returns to S1122.

At S1125, the ink supply control unit 209 stops the ink circulation within the circulation path. Specifically, the ink supply control unit 209 stops the supply pump P1 and the collecting pump P2 and closes the atmosphere open valve V0, the supply valve V2, and the collecting valve V4. Due to this, the ink circulation stops and the backflow due to the water head difference between the sub tank 151 and the print head 8 is also suppressed. Further, by closing the atmosphere open valve V0, leakage of ink and evaporation of ink from the sub tank 151 are suppressed. The above is the contents of the HB inspection circulation sequence.

<About Specific Case>

In the following, a specific case by the printing apparatus according to one embodiment of the present invention is explained by using FIG. 12. In the following explanation, explanation is given by supposing a case where the printing apparatus is used by a user in an office. Further, in the one-day cycle in the office, the time at which one or a plurality of users starts business is referred to as the business start time and the time at which the business ends as the business end time.

Figure 12:
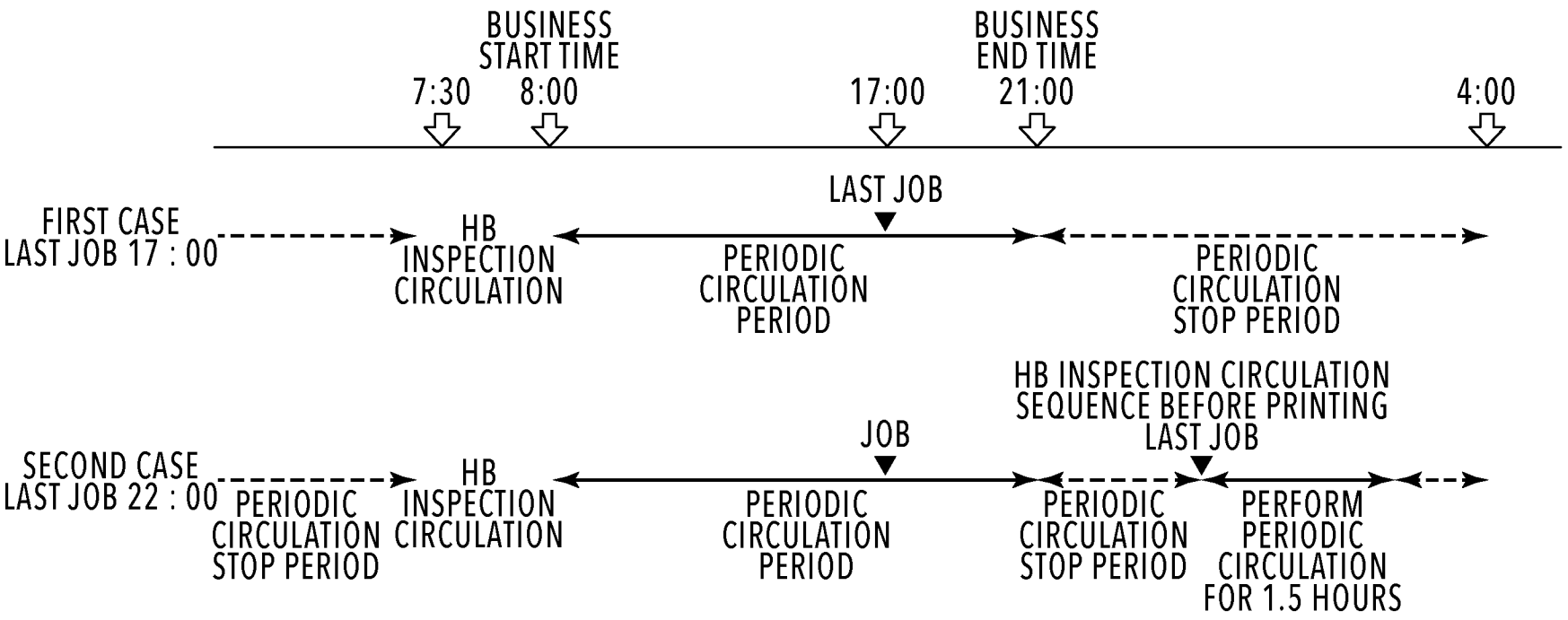
FIG. 12 is a diagram showing a specific case.

First, a first case in FIG. 12 is explained. In this case, at 7:30, the HB inspection circulation sequence (YES at S1110 in FIG. 11A→S1120) is performed and in the ink supply system, ink circulation is performed. After this, it is made possible to use the printing apparatus 1 without the need to perform ink circulation, and therefore, it is no longer necessary for a user who performs a print job to wait.

After the HB inspection circulation sequence, at 8:00, the business in the office starts. In this case, it is assumed that the business start time of the office is 8:00 and the business end time is 21:00. Then, the business hours of the office are 13 hours. During the business hours, the periodic circulation sequence in which the ink circulation is performed periodically in the ink supply system of the printing apparatus 1 is performed (YES at S901 in FIG. 9→NO at S902→S904→S905→S906). The period (in this case, 8:00 to 21:00) during which the periodic circulation sequence is performed is referred to as "periodic circulation period". By performing the periodic circulation sequence, the state where the printing apparatus 1 is usable is maintained without ink circulation. In this case, as an example, it is assumed that ink circulation is performed every 30 minutes (that is, in equation (1) described previously, Int is set to 30 minutes) and the last print job of the day is completed at 17:00.

After that, the business ends at 21:00. In this case, the printing apparatus 1 is set so as not to perform the periodic circulation sequence between 21:00 and 8:00 next day and a case where no print job is input during this period is shown. The period such as this during which the periodic circulation sequence is not performed is referred to as "periodic circulation suspension period".

As described above, during the business hours, that is, between 8:00 and 21:00, the state where it is possible to use the printing apparatus 1 without delay is maintained (that is, periodic circulation period is maintained). On the other hand, between 21:00 and 8:00 next day, which are not the business hours, the state where it is possible to use the printing apparatus 1 without delay is not maintained (that is, periodic circulation suspension period is maintained). By providing the periodic circulation suspension period, it is made possible to reduce power consumption per day compared to a case where the periodic circulation sequence is performed all day long.

Following the above, the second case in FIG. 12 is explained. In this case also, as in the first case, the HB inspection circulation sequence is performed at 7:30 and the ink circulation is performed in the ink supply system of the printing apparatus 1.

After the HB inspection circulation sequence, business starts at 8:00. In this case, the business start time is 8:00 and the business end time is 21:00, and therefore, the business hours are 13 hours. During the business hours, the periodic circulation sequence in which the ink circulation is performed periodically in the ink supply system of the printing apparatus 1 is performed (YES at S901 in FIG. 9→NO at S902→S904→S905→S906). By performing the periodic circulation sequence, the state where the printing apparatus 1 is usable is maintained without ink circulation. In this case also, as in the first case, the ink circulation is performed every 30 minutes.

After this, business ends at 21:00. In this case also, as in the first case, the setting is performed for the printing apparatus 1 so that the periodic circulation period is between 8:00 and 21:00, that is, the business hours, and the periodic circulation suspension period is between 21:00 and 8:00 next day, not the business hours. However, different from the first case, this case assumes that the last print job of the day is completed at 22:00. As described above, this case shows a case where the printing apparatus 1 is used in the time zone in which the use of the printing apparatus 1 is not supposed.

It is necessary for a user who uses the printing apparatus 1 during the periodic circulation suspension period to wait from the start of execution of the ink circulation, which is the preparation operation, until completion thereof before using the printing apparatus 1, but it is assumed that the first time use of the printing apparatus 1 during the periodic circulation suspension period does not bring about any problem because the frequency thereof is low. However, the use of the printing apparatus 1 during the periodic circulation suspension period, that is, in the time zone in which the use is not supposed suggests the possibility that the printing apparatus 1 is used again after this time zone. In a case where the periodic circulation sequence is not performed after this, it becomes necessary for a user to wait from the start of execution of the ink circulation until completion thereof because the HB inspection circulation sequence is performed at the time of using the printing apparatus 1 again in the time zone (in this case, after 22:00) in which the use is not supposed. Consequently, this is inconvenient to a user. In order to solve this problem, as described previously, in a case where a print job is performed during the periodic circulation suspension period, the periodic circulation sequence is performed only during a predetermined period after completion of the print job (YES at S902 in FIG. 9→YES at S903→S904→S905→S906).

In this example, as shown schematically, only for 90 minutes from 22:00 at which the last print job of the day is completed, the periodic circulation sequence in which the periodic circulation of ink is performed every 30 minutes is performed (that is, the value of the predetermined time used at S903 is set to 90 minutes). Due to this, it is made possible for a user who uses the printing apparatus 1 in the time zone (more specifically, between 22:00 and 23:30) after 21:00 in which the use of the printing apparatus 1 is not supposed to use the printing apparatus 1 without delay.

As described above, in this case, the periodic circulation sequence is performed for the predetermined period on a condition that a print job is performed during the periodic circulation suspension period. From this case, it is known that the power consumption is reduced compared to a case where the periodic circulation sequence is performed all day long while suppressing a reduction in usability and productivity.

Both the first case and the second case in FIG. 12 show a case where the HB inspection circulation sequence accompanied by the ink stir is performed before business starts. However, it is not necessarily required to perform the HB inspection circulation sequence without fail at the time of a transition from the periodic circulation suspension period into the periodic circulation period. As the case may be, it may also be possible to omit the HB inspection circulation sequence at the time of a transition from the periodic circulation suspension period into the periodic circulation period. For example, in a case where the predetermined number of print jobs or more print jobs are performed during the periodic circulation suspension period and during a predetermined period before the stir time or during a predetermined period before the business start time, it is possible to omit the HB inspection circulation sequence. The reason is that it is possible to regard the ink as having been stirred sufficiently within the circulation path in the case such as this, and therefore, it is not necessary to perform the ink stir anew.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

By the present invention, it is made possible to reduce power consumption while preventing a reduction in productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189645, filed Oct. 5, 2018, which is hereby incorporated by reference herein in its entirety.

What is claimed is:

1. A printing apparatus comprising:

a print head including an ejection port configured to eject a liquid, supplied from a liquid storage portion, to a printing medium;

a circulation unit configured to circulate the liquid in a circulation path that includes at least a portion of a flow path from the liquid storage portion to the ejection port; and a control unit configured to control the circulation unit to execute periodic circulation by causing the circulation unit to circulate the liquid in the circulation path, wherein the control unit is configured to (i) execute the periodic circulation by causing the circulation unit to circulate the liquid in the circulation path in a first predetermined period and (ii), in a case where the print job is executed in a second predetermined period from the end of the first predetermined period to resumption of the first predetermined period, execute a periodic circulation by causing the circulation unit to circulate the liquid in the circulation path for a predetermined period of time in response to a print job being executed.

2. The printing apparatus according to claim 1, wherein the print head has an ejection unit including a plurality of ejection ports configured to eject the liquid supplied from the liquid storage portion.

3. The printing apparatus according to claim 2, further comprising an inspection unit configured to inspect whether the ejection unit can eject the liquid normally while circulating the liquid in a case where a transition is made from a period of periodic circulation into a suspension period.

4. The printing apparatus according to claim 3, wherein, in a case where a predetermined number of print jobs are performed during the suspension period, inspection by the inspection unit is not performed.

5. The printing apparatus according to claim 1, further comprising:

a first timer that counts a time for acquiring the current time; and a second timer that counts a time having elapsed after completion of a print job, wherein the control means decides the end of the first predetermined period according to the time counted by the first timer, and decides the predetermined period of time according to the time counted by the second timer.

6. The printing apparatus according to claim 1, further comprising an input unit configured to receive information from a user on when a suspension period ends.

7. The printing apparatus according to claim 6, wherein the input unit is configured to receive an input from the user for setting the first predetermined period.

8. The printing apparatus according to claim 1, further comprising an input unit configured to receive information from a user on when a fixed suspension period ends.

9. The printing apparatus according to claim 1, wherein the circulation path includes the liquid storage portion.

10. The printing apparatus according to claim 1, wherein the print head includes (i) a printing element corresponding to the ejection port for generating energy used for ejecting the liquid from the ejection port and (ii) a pressure chamber in an area facing to the printing element, and wherein the circulation path includes the pressure chamber.

11. The printing apparatus according to claim 10, wherein the circulation path includes the print head.

12. The printing apparatus according to claim 1, wherein the predetermined period time is shorter than time of the first predetermined period.

13. The printing apparatus according to claim 1, wherein the control unit does not execute the periodic circulation by causing the circulation unit to circulate the liquid in the circulation path in the second predetermined period excluding the predetermined period.

14. The printing apparatus according to claim 1, wherein an interval of periodic circulation performed in the first predetermined period is equal to an interval of periodic circulation performed in the predetermined period.

15. A method of controlling a printing apparatus, the printing apparatus comprising (a) a print head including an ejection port configured to eject a liquid, supplied from a liquid storage portion, to a printing medium; (b) a circulation unit configured to circulate the liquid in a circulation path that includes at least a portion of a flow path from the liquid storage portion to the ejection port; and (c) a control unit configured to control the circulation unit to execute periodic circulation by causing the circulation unit to circulate the liquid in the circulation path, the control method comprising:

performing execution of periodic circulation by causing the circulation unit to circulate the liquid in the circulation path in a first predetermined period; and performing, in response to execution of a print job in a case where the print job is executed in a second predetermined period from the end of the first predetermined period to resumption of the first predetermined period, execution of periodic circulation by causing the circulation unit to circulate the liquid in the circulation path for a predetermined period of time that is shorter than time of the first predetermined period.

16. The method of controlling the printing apparatus according to claim 15, wherein the print head has an ejection unit including a plurality of ejection ports configured to eject the liquid supplied from the liquid storage portion.

17. The method of controlling the printing apparatus according to claim 16, wherein the printing apparatus further comprises an inspection unit configured to inspect whether the ejection unit can eject the liquid normally while circulating the liquid in a case where a transition is made from a period of periodic circulation into a suspension period.

18. The method of controlling the printing apparatus according to claim 17, wherein the printing apparatus is configured such that in a case where a predetermined number of print jobs are performed during the suspension period, inspection by the inspection unit is not performed.

19. The method of controlling the printing apparatus according to claim 15, wherein the printing apparatus further comprises a first timer that counts a time for acquiring the current time and a second timer that counts a time having elapsed after completion of a print job, and wherein the control means decides the end of the first predetermined period according to the time counted by the first timer, and decides the predetermined period of time according to the time counted by the second timer.

20. The method of controlling the printing apparatus according to claim 15, wherein the printing apparatus further comprises an input unit configured to receive information from a user when a suspension period elapses.

21. The method of controlling the printing apparatus according to claim 20, wherein the input unit is configured to receive an input from a user for setting the first predetermined period.

22. The method of controlling the printing apparatus according to claim 15, wherein the printing apparatus further comprises an input unit configured to receive information from a user on when a fixed suspension period ends.

23. The method of controlling the printing apparatus according to claim 15, wherein the circulation path includes the liquid storage portion.

24. The method of controlling the printing apparatus according to claim 15, wherein the print head includes (i) a printing element corresponding to the ejection port for generating energy used for ejecting the liquid from the ejection port and (ii) a pressure chamber in an area facing to the printing element, and wherein the circulation path includes the pressure chamber.

25. The method of controlling the printing apparatus according to claim 24, wherein the circulation path includes the print head.

26. The method of controlling the printing apparatus according to claim 15, wherein the control unit does not execute the periodic circulation by causing the circulation unit to circulate the liquid in the circulation path in the second predetermined period excluding the predetermined period.

* * * * *